US012612722B2

(12) United States Patent
Hosokawa et al.

(10) Patent No.: US 12,612,722 B2
(45) Date of Patent: Apr. 28, 2026

(54) WASHING MACHINE INCLUDING DAMPER FOR DAMPING VIBRATION OF TUB

(71) Applicant: SAMSUNG ELECTRONICS CO., LTD., Suwon-si (KR)

(72) Inventors: Akihiro Hosokawa, Kanagawa (JP); Kazushi Mori, Kanagawa (JP); Yuichi Suzuki, Kanagawa (JP); Takahiro Nakashima, Kanagawa (JP); Yoshiyuki Nishioka, Kanagawa (JP); Hogyo Hoshiyama, Kanagawa (JP); Doyeon Kim, Suwon-si (KR); Yongsoo Kyong, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 366 days.

(21) Appl. No.: 18/332,755

(22) Filed: Jun. 12, 2023

(65) Prior Publication Data

US 2023/0407545 A1 Dec. 21, 2023

Related U.S. Application Data

(63) Continuation of application No. PCT/KR2023/006219, filed on May 8, 2023.

(30) Foreign Application Priority Data

Jun. 21, 2022 (JP) ..... 2022-099548
Dec. 28, 2022 (JP) ..... 2022-212081

(51) Int. Cl.
*D06F 37/22* (2006.01)
*D06F 37/04* (2006.01)

(52) U.S. Cl.
CPC ..... *D06F 37/22* (2013.01); *D06F 37/04* (2013.01)

(58) Field of Classification Search
CPC ..... D06F 37/22; D06F 37/04
(Continued)

(56) References Cited

U.S. PATENT DOCUMENTS 10,598,244 B2 3/2020 Bauer et al.
11,578,450 B2 2/2023 Nakashima et al.
(Continued)

FOREIGN PATENT DOCUMENTS

EP 1477604 A2 11/2004
EP 1728004 B1 12/2010
(Continued)

OTHER PUBLICATIONS

KR20160117950A—machine translation (Year: 2016).*
(Continued)

*Primary Examiner* — Tinsae B Ayalew
(74) *Attorney, Agent, or Firm* — CANTOR COLBURN LLP

(57) ABSTRACT

A washing machine includes a damper to reduce a vibration. The damper includes a damper frame and a rod respectively supported by the tub and the housing. The rod may move relative to the damper frame in an axial direction by being inserted into a support portion of the damper frame. A rotation movement member is movable in the axial direction by rotating with respect to the damper frame. A friction member is disposed between the support portion and the rotation movement member and applies a friction force to the rod. A switching unit switches, by rotating the rotation movement member, the damper between a first state in which the friction member is movable together with the damper frame with respect to the rod and a second state in which the friction member is movable together with the rod with respect to the damper frame.

15 Claims, 22 Drawing Sheets

(58) Field of Classification Search
USPC ..... 68/3 R
See application file for complete search history.

(56) References Cited

U.S. PATENT DOCUMENTS

| | | | | |
|---|---|---|---|---|
| 2004/0231373 | A1 | 11/2004 | Kim et al. | |
| 2006/0011429 | A1 | 1/2006 | Park et al. | |
| 2011/0113832 | A1 | 5/2011 | Ackermann et al. | |
| 2016/0326679 | A1* | 11/2016 | Jung | D06F 37/24 |

FOREIGN PATENT DOCUMENTS

| | | | |
|---|---|---|---|
| EP | 2665854 | B1 | 11/2015 |
| JP | 9317809 | A | 12/1997 |
| JP | 200629585 | A | 2/2006 |
| JP | 2020041584 | A | 3/2020 |
| KR | 20030072939 | A | 9/2003 |
| KR | 20040099696 | A | 12/2004 |
| KR | 20050066295 | A | 6/2005 |
| KR | 1020060005580 | A | 1/2006 |
| KR | 1020130037952 | A | 4/2013 |
| KR | 101416184 | B1 | 7/2014 |
| KR | 1020160117950 | A | 10/2016 |
| KR | 20200140699 | A | 12/2020 |
| KR | 102331601 | B1 | 11/2021 |
| WO | 2006037767 | A1 | 4/2006 |

OTHER PUBLICATIONS

International Search Report mailed Jul. 26, 2023 for PCT/KR2023/006219, in conformance with MPEP 609—Concise explanation of the relevance includes issue date of foreign OA and references cited therein.

The extended European search report for EP Application No. 23827365.0 mailed on May 8, 2025.

European Notice of Allowance for EP Application No. 23827365.0 mailed on Jan. 27, 2026.

* cited by examiner

WASHING MACHINE INCLUDING DAMPER FOR DAMPING VIBRATION OF TUB

CROSS-REFERENCE TO RELATED APPLICATIONS

This application is a continuation application, under 35 U.S.C. § 111(a), of International Patent Application No. PCT/KR2023/006219, filed on May 8, 2023, which claims priority to Japanese Patent Application No. 2022-099548, filed on Jun. 21, 2022 and Japanese Patent Application No. 2022-212081, filed on Dec. 28, 2022, the content of which in their entirety is herein incorporated by reference.

TECHNICAL FIELD

The disclosure relates to a washing machine to which a damper for damping a vibration of a tub is applied.

BACKGROUND ART

There is a proposed washing machine having a damper of which a damping force is changed according to a vibration level of an object co-vibrating with a tub so as to effectively dampen a vibration. For example, a washing machine disclosed in Japanese Patent Application Publication No. 2006-29585 includes a damper cylinder, a shaft inserted from one end of the damper cylinder so as to reciprocate in a lengthwise direction of the damper cylinder, and a friction member provided to the shaft so as to dampen a vibration due to a friction force with respect to an inner wall of the damper cylinder and to be movable in a direction perpendicular to the lengthwise direction of the damper cylinder.

SUMMARY

In an embodiment of the disclosure, in a washing machine, a tub may be supported to be relatively movable in a housing. A drum may be rotatably disposed (e.g., mounted) in the tub. A damper for reducing a vibration may be provided between the housing and the tub. The damper may include a damper frame and a rod. One end of the damper frame may be supported by one of the housing and the tub. One end of the rod may be supported by the other one of the housing and the tub. The other end of the rod may be inserted into a support portion of the damper frame. The rod may be movable with respect to the damper frame according to relative movement of the housing and the tub. The damper may further include a rotation movement member, a friction member, and a switching unit. The rotation movement member may be provided around the rod in the damper frame. The rotation movement member may rotate with respect to the damper frame, thereby being movable with respect to the damper frame in an axial direction of the rod. The friction member may be disposed between the support portion of the damper frame and the rotation movement member in the axial direction. The friction member may apply a friction force to the rod by contacting an outer circumferential surface of the rod. The switching unit may switch, by rotating the rotation movement member, a state of the damper between a first state and a second state. The first state may be a state in which the friction member is movable together with the damper frame with respect to the rod. The second state may be a state in which the friction member is movable together with the rod with respect to the damper frame.

BRIEF DESCRIPTION OF DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
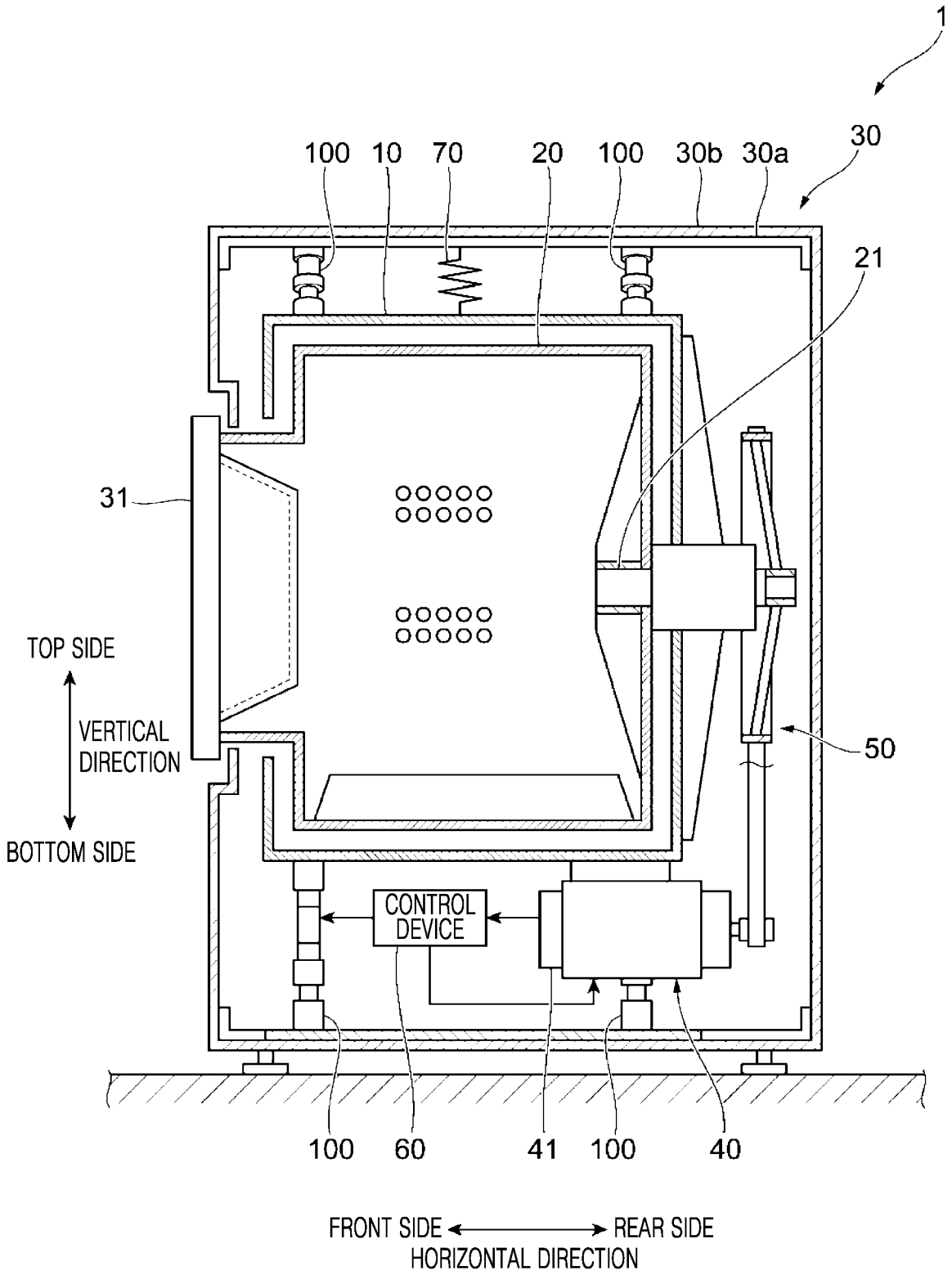
FIG. 1 illustrates a schematic configuration of an embodiment of a washing machine according to the disclosure.

Throughout the disclosure, the expression "at least one of a, b, or c" indicates only a, only b, only c, both a and b, both a and c, both b and c, all of a, b, and c, or variations thereof.

It should be appreciated that various embodiments of the disclosure and the terms used therein are not intended to limit the technological features set forth herein to particular embodiments of the disclosure, and include various changes, equivalents, or alternatives for a corresponding embodiment.

With reference to descriptions of drawings, similar reference numerals may be used to refer to similar or related elements.

It is to be understood that a singular form of a noun corresponding to an item may include the item or a plurality of the items, unless the context clearly indicates otherwise.

As used herein, expressions such as "A or B", "at least one of A and B", "at least one of A or B", "A, B or C", "at least one of A, B, and C", "at least one of A, B, or C" may include any one of, or all available combinations of the items enumerated together in a corresponding one of the phrases.

As used herein, the term "and/or" includes any one or a combination of a plurality of related recited elements.

Terms such as "1st" and "2nd" or "first" and "second" may be used to simply distinguish a corresponding element from another, and does not limit the elements in other features (e.g., importance or order).

When an element (e.g., a first element) is referred to, with or without the term "operatively" or "communicatively", as being "coupled with," "coupled to," "connected with," or "connected to" another element (e.g., a second element), it means that the element may be connected to the other element directly (e.g., in a wired manner), wirelessly, or via a third element.

As used here, such terms as "comprises," "includes," or "has" specify the presence of stated features, numbers, stages, operations, elements, parts, or a combination thereof, but do not preclude the presence or addition of one or more other features, numbers, stages, operations, elements, parts, or a combination thereof.

When an element is referred to as being "connected to," "coupled to," "supported by," or "in contact with" another element, it means that the element is directly connected to, coupled to, supported by, or in contact with the other element, or that the element is indirectly connected to, coupled to, supported by, or in contact with the other element via a third element.

When an element is referred to as being "on" another element, it means that the element is in contact with the other element, or that still another element is between the element and the other element.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

A washing machine according to various embodiments of the disclosure may perform washing, rinse, spin, and drying cycles. A washing machine is an embodiment of a laundry treatment apparatus, and the laundry treatment apparatus is a concept collectively including an apparatus for washing clothes (a target object to be washed and a target object to be dried), an apparatus for drying clothes, and an apparatus capable of performing both washing and drying of clothes.

A washing machine according to various embodiments of the disclosure may include a top-loading washing machine in which an inlet for putting in or taking out laundry is provided at the top, or a front-loading washing machine in which an inlet for putting in or taking out laundry is provided at the front. The washing machine according to various embodiments of the disclosure may include a washing machine of a loading type other than the top-loading washing machine and the front loading washing machine.

The top-loading washing machine may wash laundry by a water current generated by a rotating body such as a pulsator. The front-loading washing machine may wash laundry by rotating a drum to repeatedly raise and drop the laundry. The front-loading washing machine may include a washing and drying-combination machine capable of drying laundry in a drum thereof. The washing and drying-combination machine may include a hot air supply device for supplying high-temperature air to the inside of the drum and a condensing device for removing moisture in an air discharged from the drum. In an embodiment, the washing and drying-combination machine may include a heat pump device, for example. The washing machine according to various embodiments of the disclosure may include washing machines with washing schemes different from washing schemes described above.

The washing machine according to various embodiments of the disclosure may include a housing for internally accommodating various elements. The housing may be provided in a box shape including an inlet that is formed at one side for putting in laundry.

The washing machine may include a door for opening and closing the inlet for putting in laundry. The door may be rotatably disposed (e.g., mounted) on the housing by a hinge. At least a portion of the door may be transparent or translucent such that the interior of the housing is visible.

The washing machine may include a tub provided in the housing so as to store water. The tub may be provided having a substantially cylindrical shape with a tub opening at one side, and may be arranged in the housing so as to allow the tub opening to correspond to the inlet for putting in laundry.

The tub may be connected to the housing by a damper. The damper may absorb a vibration occurring in rotation of the drum, and thus, may dampen the vibration transferred to the housing.

The washing machine may include a drum provided to accommodate laundry.

The drum may be provided in the tub so as to allow a drum opening at one side of the drum to correspond to the inlet for putting in laundry and the tub opening. Laundry may sequentially pass through the inlet for putting in laundry, the tub opening, and the drum opening so as to be accommodated in the drum or may be taken out of the drum.

The drum rotates in the tub, thereby performing each operation according to washing, rinse, and/or spin cycles. The drum may include a plurality of through holes in its cylindrical wall, such that water stored in the tub may flow into the drum or may be discharged out of the drum.

The washing machine may include a driving device which rotates the drum. The driving device may include a drive motor, and a rotation shaft for transmitting a driving force generated by the drive motor to the drum. The rotation shaft may be connected to the drum via the tub.

The driving device may perform each operation according to washing, rinse, and/or spin cycles, or a drying cycle by rotating the drum forward or backward.

The washing machine may include a water supply device which supplies water into the tub. The water supply device may include a water supply pipe, and a water supply valve provided at the water supply pipe. The water supply pipe may be connected to an external water supply source. The water supply pipe may be extended from the external water supply source to a detergent supply device and/or the tub. Water may be supplied into the tub via the detergent supply device. Water may be supplied into the tub without going via the detergent supply device.

The water supply valve may open or close the water supply pipe, in response to an electric signal of a controller. The water supply valve may allow or block the supply of water from the external water supply source to the tub. In an embodiment, the water supply valve may include a solenoid valve being open or close, in response to an electric signal, for example.

The washing machine may include the detergent supply device which supplies a detergent to the tub. The detergent supply device may include a manual-type detergent supply device to which a user inputs a detergent to be used in every washing, and an automatic-type detergent supply device that stores a relatively large amount of detergents and automatically inputs a preset amount of detergent in washing. The detergent supply device may include a detergent box to store a detergent. The detergent supply device may supply a detergent into the tub in a water supply process. Water supplied via the water supply pipe may be mixed with a detergent via the detergent supply device. The water mixed with the detergent may be supplied into the tub. The term 'detergent' is used to collectively refer to a detergent for pre-washing, a detergent for main-washing, a fabric softer, a bleaching agent, or the like, and the detergent box may be partitioned into a storage area of a detergent for pre-washing, a storage area of a detergent for main-washing, a storage area of a fabric softer, and a storage area of a bleaching agent.

The washing machine may include a drain device which externally discharges water from the tub. The drain device may include a drain pipe extending from the bottom of the tub to the outside of the housing, a drain valve provided at the drain pipe so as to open/close the drain pipe, and a pump provided on the drain pipe. The pump may pump water of the drain pipe to the outside of the housing.

The washing machine may include a control panel provided at one side of the housing. The control panel may provide a user interface for interaction between a user and the washing machine. The user interface may include at least one input interface and at least one output interface.

The at least one input interface may convert sensory information received from the user into an electric signal.

The at least one input interface may include a power button, an operation button, a course selection dial (or a course selection button), and a washing/rinse/spin setting button. The at least one input interface may include a tact switch, a push switch, a slide switch, a toggle switch, a micro-switch, a touch switch, a touch pad, a touch screen, a jog dial, and/or a microphone.

The at least one output interface may visually or acoustically transmit information related to an operation of the washing machine to a user.

In an embodiment, the at least one output interface may transmit, to the user, information related to a washing course and operation time of the washing machine, and information related to a washing setting/rinse setting/spin setting, for example. The information about the operation of the washing machine may be output to a screen or as an indicator, a voice, or the like. The at least one output interface may include a liquid-crystal display (LCD) panel, a light-emitting diode (LED) panel, a speaker, or the like.

The washing machine may include a communication module for wired and/or wireless communication with an external device.

The communication module may include at least one of a short-range communication module or a long-range communication module.

The communication module may transmit data to an external device (e.g., a server, a user device and/or home appliance) or may receive data from the external device. In an embodiment, the communication module may establish communication with a server and/or a user device and/or home appliance, and may transmit and receive various data, for example.

To this end, the communication module may support establishment of a direct (e.g., wired) communication channel or a wireless communication channel with the external device, and communication via the established communication channel. In an embodiment of the disclosure, the communication module may include a wireless communication module (e.g., a cellular communication module, a short-range wireless communication module, or a global navigation satellite system (GNSS) communication module) or a wired communication module (e.g., a LAN communication module, or a power line communication module). A corresponding communication module from among communication modules may communicate with the external device via a first network (a short-range communication network such as Bluetooth, wireless fidelity (WiFi) direct, or infrared data association (IrDA)) or a second network (a long-range communication network such as a legacy cellular network, a $5^{th}$ generation (5G) network, a next-generation communication network, the Internet, or a computer network (e.g., a LAN or a wide area network (WAN))). The various types of communication modules may be integrated as one element (e.g., a single chip) or separate elements (e.g., a plurality of chips).

A short-range wireless communication module may include, but is not limited to, a Bluetooth communication module, a Bluetooth Low Energy (BLE) communication module, a near field communication (NFC) module, a WLAN (Wi-Fi) communication module, a ZigBee communication module, an IrDA communication module, a WiFi direct (WFD) communication module, an ultra wideband (UWB) communication module, an Ant+ communication module, a microwave (pWave) communication module or the like.

A long-range communication module may include communication modules for performing various types of long-range communication, and may include a mobile communication unit. The mobile communication unit transmits and receives a wireless signal to and from at least one of a base station, an external terminal, or a server, on a mobile communication network.

In an embodiment of the disclosure, the communication module may communicate with the external device including a server, a user device, other home appliances, or the like via a neighboring access point (AP). The AP may connect a LAN to which the washing machine or the user device is connected to a WAN to which the server is connected. The washing machine or the user device may be connected to the server via the WAN. A control unit may control various elements (e.g., the drive motor, the water supply valve, etc.) of the washing machine. The control unit may control various elements of the washing machine to perform at least one cycle including water supply, washing, rinse, and/or spin, in response to a user input. In an embodiment, the control unit may control the drive motor to adjust a rotation speed of the drum or may control the water supply valve of the water supply device to supply water to the tub, for example.

The control unit may include hardware such as a central processing unit (CPU), a memory, or the like, and software such as a control program, or the like. In an embodiment, the control unit may include at least one memory storing data in forms of algorithm and a program to control operations of elements in the washing machine, and at least one processor to perform the aforementioned operation by the data stored in the at least one memory, for example. The memory and the processor may each be implemented as a separate chip. The processor may include one processor chip or two or more processor chips, or may include one processing core or two or more processing cores. The memory may include one memory chip or two or more memory chips or may include one memory block or two or more memory blocks. Also, the memory and the processor may be implemented as one chip.

Hereinafter, with reference to the accompanying drawings, embodiments of a washing machine according to the disclosure will now be described in detail.

FIG. 1 illustrates a schematic configuration of an embodiment of a washing machine 1 according to the disclosure. FIG. 1 illustrates a cross-sectional view of the washing machine 1, viewed from the right direction. The left side of FIG. 1 shows the front of the washing machine 1, the right side of the FIG. 1 shows the rear of the washing machine 1, the upper side of FIG. 1 corresponds to the upper side of the washing machine 1, and the lower side of FIG. 1 corresponds to the lower side of the washing machine 1. Referring to FIG. 1, the washing machine 1 in an embodiment of the disclosure may include a tub 10, a drum 20 in an embodiment of a rotational member rotatably disposed (e.g., mounted) in the tub 10, and a housing 30 accommodating the tub 10 and the drum 20.

A rotation axis 21 of the drum 20 extends in front and rear directions. When the washing machine 1 is viewed from the front side, a rotation direction of the drum 20 may be a left rotation (a counterclockwise rotation). An exterior of the housing 30 may be a substantially quadrangular shape, e.g., rectangular shape. The housing 30 may include a frame 30*a* forming a body and including steel, and may include a steel plate 30*b* having lower hardness than that of the frame 30*a*. An opening for putting in laundry is defined at the front of the housing 30. A door 31 is disposed (e.g., mounted) on the housing 30 so as to open/close the opening.

The washing machine 1 may include a motor 40, a transmission unit 50 for transmitting a rotation force of the motor 40 to the rotation axis 21 of the drum 20, and a control device 60 controlling driving of the motor 40. In an embodiment, the motor 40 may be a three-phase brushless motor having a rotation angle detector 41 to detect a rotation angle of the motor 40, for example. The rotation angle detector 41 may be a resolver, a rotary encoder, or the like. The transmission unit 50 may include a pulley disposed (e.g., mounted) at the rotation axis 21, a belt wound between pulleys, or the like. The control device 60 may be an arithmetic logic operation circuit including a CPU, a read-only memory (ROM), a random-access memory (RAM), a backup RAM, or the like. An output signal of the rotation angle detector 41 of the motor 40 is input to the control device 60. The control device 60 sets a target current to be supplied to the motor 40, based on the output signal of the rotation angle detector 41, and performs feedback control, based on the set target current.

The tub 10 is supported to be relatively movable in the housing 30. In an embodiment, the washing machine 1 may include a spring 70 provided between the frame 30*a* of the housing 30 and the tub 10, for example. In an embodiment, the spring 70 may be provided in a multiple number, for example.

The washing machine 1 may include a damper 100 in an embodiment of a damping device that is disposed (e.g., mounted) between the frame 30*a* of the housing 30 and the tub 10 so as to dampen a vibration of the tub 10. In an embodiment, the washing machine 1 may include four dampers 100 connected between four corners of the bottom of the tub 10 and the frame 30*a* of the bottom part of the housing 30, for example. In an embodiment, the washing machine 1 may further include two dampers 100 connected between the front and the rear of the tub 10 at the top-left side and the frame 30*a* at the top-left of the housing 30, and two dampers 100 connected between the front and the rear of the tub 10 at the top-right side and the frame 30*a* at the top-right of the housing 30, for example. The number of dampers 100 is not limited to eight. In an embodiment, the washing machine 1 may not include any one of the eight dampers 100 described above, or may further include another damper 100 in addition to the eight dampers 100 described above, for example.

Figure 2:
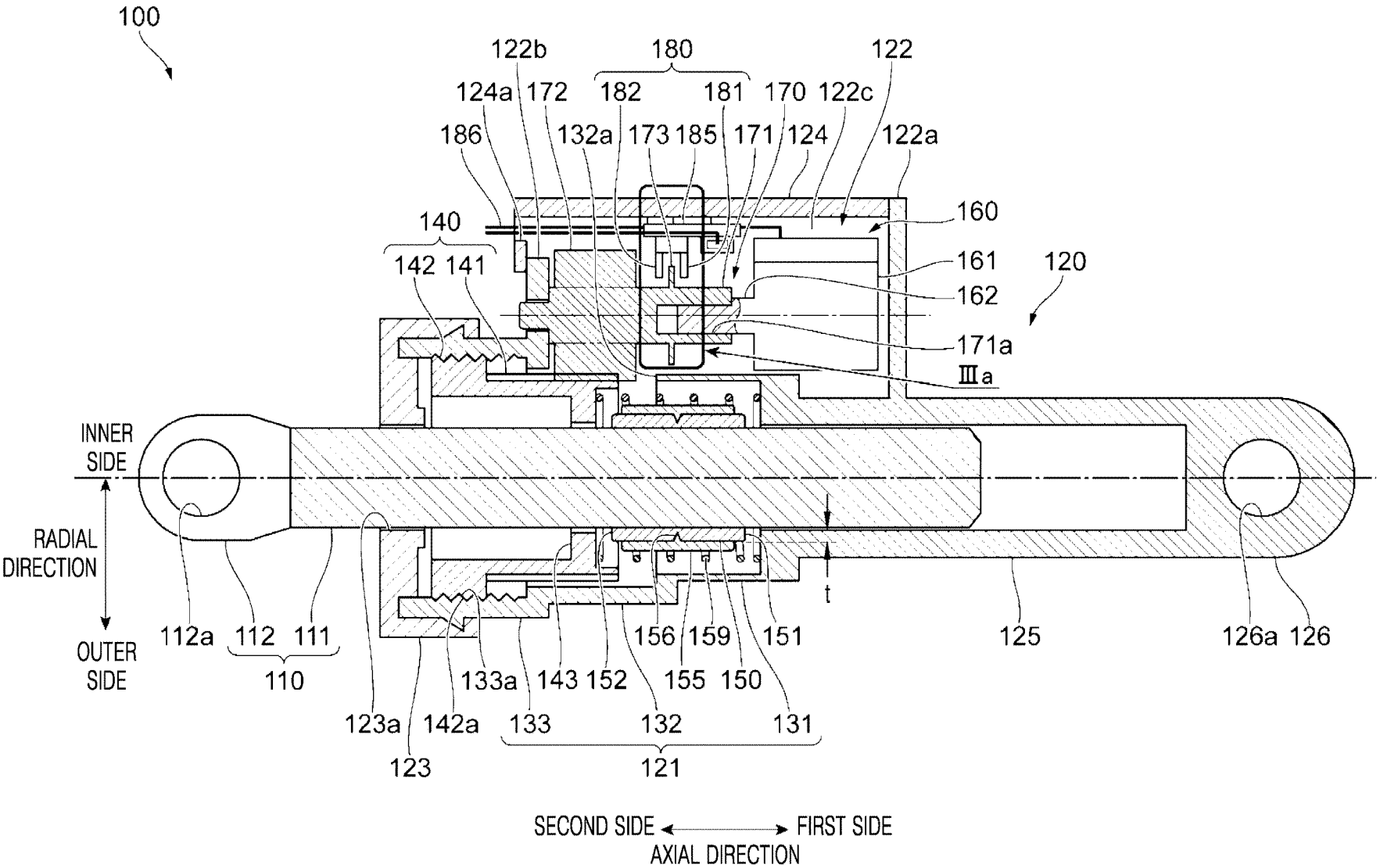
FIG. 2 illustrates a schematic configuration of an embodiment of a damper according to the disclosure.
Figure 3A:
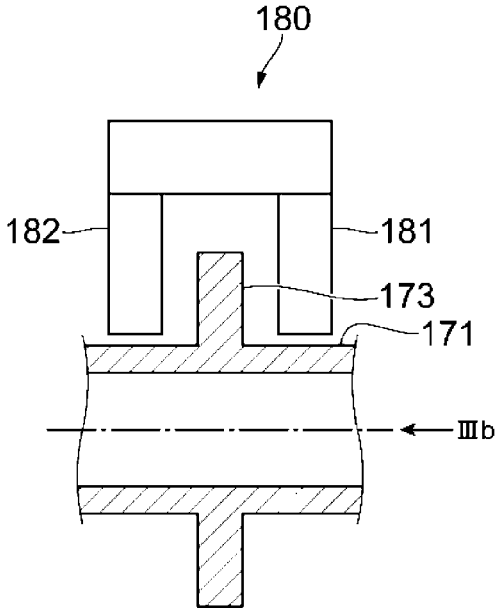
FIG. 3A is a magnified view of a portion IIIa of the damper of FIG. 2.
Figure 3B:
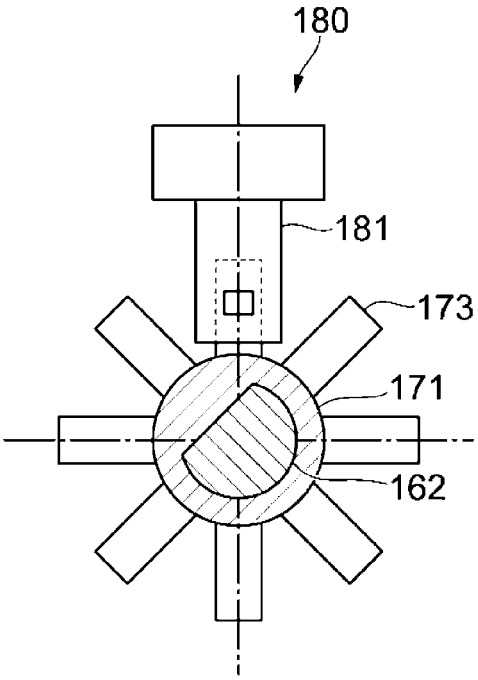
FIG. 3B illustrates a sensor viewed in a direction IIIb of FIG. 3A.

FIG. 2 illustrates a schematic configuration of an embodiment of the damper 100 according to the disclosure. FIG. 3A is a magnified view of a portion liIa of the damper 100 of FIG. 2. FIG. 3B illustrates a sensor 180 viewed in a direction IIIb of FIG. 3A.

First, referring to FIG. 2, the damper 100 includes a rod 110 with a pole shape including one end supported by the housing 30, and a damper frame 120 which includes one end supported by the tub 10 and in which an opposite end of the rod 110 is inserted. The damper 100 further includes a screw gear 140. The screw gear 140 is provided in the damper frame 120 and around the rod 110. The screw gear 140 may be moved in an axial direction with respect to the damper frame 120 by rotating in a direction perpendicular to an axial direction of the rod 110 with respect to the damper frame 120. The damper 100 may further include a friction member 150, a supporting member 155, and a coil spring 159. The friction member 150 is provided around the rod 110 so as to contact an outer circumferential surface of the rod 110 and apply a friction force to the rod 110. The supporting member 155 supports the friction member 150. In an embodiment, the supporting member 155 may have a cylindrical shape, for example. The friction member 150 may be supported in an inner side of the supporting member 155 with the cylindrical shape, and the rod 110 may be disposed in an inner side of the friction member 150. In an embodiment, the coil spring 159 may be a compressed coil spring. One end of the coil spring 159 is supported by the damper frame 120, and an opposite end of the coil spring 159 is supported by the screw gear 140, for example. The damper 100 may further include a switching unit 160. The switching unit 160 switches, by rotating the screw gear 140, a state of the damper 100 between a first state in which the friction member 150 is movable together with the damper frame 120 with respect to the rod 110 and a second state in which the friction member 150 is movable together with the rod 110 with respect to the damper frame 120.

The rod 110 includes a rod portion 111 with a pole shape, and a first connection portion 112 connected to the housing 30. In an embodiment, the rod portion 111 may have a cylindrical shape, for example. An outer diameter of the rod portion 111 is equal to or less than an inner diameter of a support portion 125 of the damper frame 120 which is to be described below. The first connection portion 112 is provided at one end of the rod portion 111. An opposite end of the rod portion 111 which is opposite with respect to the first connection portion 112 is slidably inserted into the support portion 125 of the damper frame 120. The rod portion 111 slides in the support portion 125 of the damper frame 120, so that the damper 100 is extended or contracted.

A pin hole 112*a* in which a pin (not shown) for connecting the rod 110 to the housing 30 is disposed is defined in the first connection portion 112. In an embodiment, the pin hole 112*a* may have a cylindrical shape, for example.

Hereinafter, a center line direction of the rod portion 111, in other words, a movement direction of the rod portion 111 with respect to the damper frame 120 is also referred to as the "axial direction". In the axial direction, the side of the tub 10 (the right side of FIG. 2) is also referred to as the "first side", and the side of the housing 30 (the left side of FIG. 2) is also referred to as the "second side". The radial direction of the rod portion 111 (the vertical direction of FIG. 2) is also referred to as the "radial direction", the center line side of the rod portion 111 is also referred to as the "inner side", and the side away from the center axis is also referred to as the "outer side".

The damper frame 120 includes an accommodation part (a first accommodation part 121) that accommodates the screw gear 140 (a rotation movement member). In an embodiment, the damper frame 120 may include the first accommodation part 121 for accommodating the screw gear 140 (the rotation movement member), the friction member 150, etc., and a second accommodation part 122 for accommodating the switching unit 160, for example. A cover (a first cover 123) covers an opening in the axial direction of the accommodation part (the first accommodation part 121), in other word, an opening in the second side. A bearing 123*a* to be described below is arranged at the first cover 123 so as to support an end of the rod 110. A second cover 124 covers an opening of the second accommodation part 122. The damper frame 120 includes the support portion 125 slidably supporting the opposite end of the rod 110, and a second connection portion 126 connected to the tub 10. The second connection portion 126, the support portion 125, the first accommodation part 121, and the first cover 123 are sequentially provided from the first side to the second side. The first accommodation part 121 and the support portion 125 may have a cylindrical shape, and the second accommodation part 122 is provided at a part of a perimeter direction of the first accommodation part 121 and the support portion 125 which is an outer side of the first accommodation part 121 and the support portion 125.

The first accommodation part 121 may include a first cylindrical-shape part 131, a second cylindrical-shape part 132, and a third cylindrical-shape part 133 which are three cylindrical-shape parts including inner diameters and outer diameters different from each other. The first cylindrical-shape part 131, the second cylindrical-shape part 132, and the third cylindrical-shape part 133 are sequentially disposed from the first side to the second side, and their inner diameters and outer diameters sequentially increase. That is, the inner diameter and the outer diameter of the second cylindrical-shape part 132 are greater than the inner diameter and the outer diameter of the first cylindrical-shape part 131, and the inner diameter and the outer diameter of the third cylindrical-shape part 133 are greater than the inner diameter and the outer diameter of the second cylindrical-shape part 132. The first cylindrical-shape part 131 accommodates the friction member 150, the supporting member 155, and the coil spring 159. The second cylindrical-shape part 132 accommodates a gear portion 141 of the screw gear 140 which is to be described below. The third cylindrical-shape part 133 accommodates a screw portion 142 of the screw gear 140 which is to be described below. A communication hole 132*a* is defined in the second cylindrical-shape part 132. The communication hole 132*a* is defined at a position corresponding to the second accommodation part 122. The second cylindrical-shape part 132 and the second accommodation part 122 internally communicate with each other via the communication hole 132*a*. Spiral grooves 133*a* extending in the axial direction are provided in an inner circumferential surface of the third cylindrical-shape part 133.

The second accommodation part 122 is a space defined by a plurality of walls provided at the outside of the first accommodation part 121. The plurality of walls may include a first wall 122*a* provided at the first side so as to be perpendicular to the axial direction, a second wall 122*b* provided at the second side so as to be perpendicular to the axial direction, and two third walls 122*c* being parallel in the axial direction. The second accommodation part 122 accommodates a motor 161, a motor gear 170, the sensor 180, and a control board 185 which configure the switching unit 160.

In an embodiment, the first cover 123 may be a member with a disk shape. The bearing 123*a* that supports a sliding operation of the rod portion 111 of the rod 110 is provided at the center portion of the first cover 123, for example. A form in which the first cover 123 is disposed (e.g., mounted) at the first accommodation part 121 is not limited to a particular form. In an embodiment, as illustrated in FIG. 2, a cylindrical-shape portion extending toward the first side from an outer circumference portion of the first cover 123 and an end of the first accommodation part 121 in the second side, e.g., an end of the third cylindrical-shape part 133 in the second side, may be combined together, for example. Furthermore, the first cover 123 may be connected to the first accommodation part 121 by a fastening member such as a screw, a bolt, etc., or the first cover 123 and the first accommodation part 121 may be adhered to each other.

The second cover 124 is disposed (e.g., mounted) at the first wall 122*a*, the second wall 122*b*, and a third wall 122*c* which configure the second accommodation part 122. A disposed (e.g., mounted) form is not limited. The second cover 124 may be connected to the first wall 122*a*, the second wall 122*b*, and the third wall 122*c* by a fastening member such as a screw, a bolt, etc., or may be adhered to the first wall 122*a*, the second wall 122*b*, and the third wall 122*c*. The control board 185 to be described below may be supported by the second cover 124. A through hole 124*a* through which a cord 186 passes is defined at the axial direction in the second cover 124.

The support portion 125 supports the sliding operation of the rod portion 111 of the rod 110. An inner diameter of the support portion 125 is greater than an outer diameter of the rod portion 111 of the rod 110. A pin hole 126*a* in which a pin (not shown) for connecting the damper frame 120 to the tub 10 is inserted is defined at the second connection portion 126. In an embodiment, the pin hole 126*a* may have a cylindrical shape, for example.

The screw gear 140 includes the gear portion 141 having a gear formed on its outer circumferential surface, and the screw portion 142 having spiral convex parts 142*a* formed on its outer circumferential surface. The gear portion 141 and the screw portion 142 are sequentially disposed from the first side to the second side. That is, the gear portion 141 is disposed at the first side, and the screw portion 142 is disposed at the second side. An inner diameter of the gear portion 141 is equal to an inner diameter of the screw portion 142. An outer diameter of the gear portion 141 is different from an outer diameter of the screw portion 142. The inner diameters of the gear portion 141 and the screw portion 142 are greater than an outer diameter of the rod portion 111 of the rod 110.

A gear surface of the gear of the gear portion 141 is parallel to the axial direction. The gear of the gear portion 141 engages with a gear 172 of the motor gear 170 which is to be described below. An axial-direction length of the gear of the gear portion 141 is greater than an axial-direction length of the gear 172 of the motor gear 170, and is determined to engage with the gear 172 of the motor gear 170 even when the screw gear 140 is moved in the axial direction. The gear portion 141 includes a protrusion portion 143. The protrusion portion 143 inwardly protrudes at an end of the gear portion 141 in the first side from an inner circumferential surface of the gear portion 141. The protrusion portion 143 supports an end of the coil spring 159 in the second side.

The spiral convex parts 142*a* of the screw portion 142 are provided near an end of the first accommodation part 121 of the damper frame 120, in other word, engage with the spiral grooves 133*a* defined in the inner circumferential surface of the third cylindrical-shape part 133. When a rotation driving force is transmitted to the screw gear 140 via the gear of the gear portion 141, the screw gear 140 rotates around the rod 110. As the spiral convex parts 142*a* engage with the spiral grooves 133*a* of the damper frame 120, the rotating screw gear 140 is moved in the axial direction.

The outer diameter of the gear portion 141 is greater than the inner diameter of the first cylindrical-shape part 131 of the first accommodation part 121 of the damper frame 120, and is less than the inner diameter of the second cylindrical-shape part 132. The outer diameter of the screw portion 142 is greater than the inner diameter of the second cylindrical-shape part 132 of the first accommodation part 121 of the damper frame 120, and the spiral convex parts 142*a* engage with the spiral grooves 133*a* of the third cylindrical-shape part 133. The gear portion 141 of the screw gear 140 is accommodated in the second cylindrical-shape part 132 and the third cylindrical-shape part 133 of the damper frame 120, and the screw portion 142 of the screw gear 140 is accommodated in the third cylindrical-shape part 133.

A material of the friction member 150 is not limited as long as the material has excellent wear resistance. In an embodiment, the material of the friction member 150 may include a urethane resin or a urethane rubber, for example. In an embodiment, the material of the friction member 150 may include nitrile butadiene rubber (NBR), hydrogenated nitrile butadiene rubber (H-NBR), ethylene-propylene diene monomer (EPDM) rubber, styrene butadiene rubber (SBR), and natural rubber (NR), for example. In an embodiment, the material of the friction member 150 may include a thermosetting resin or a thermoplastic resin, for example. Types of the thermosetting resin are not limited, and may be a phenol resin, an epoxy resin, or the like, for example. Types of the thermoplastic resin are not limited, and may be a polyamide resin, a polyimide resin, a polycarbonate resin, or the like, for example. The material of the friction member 150 may include metal. In an embodiment, the metal may include copper, brass, or the like, for example.

A shape of the friction member 150 before being assembled in the inner side of the supporting member 155 may be a quadrangular shape, e.g., rectangular shape. When the friction member 150 is assembled in the inner side of the supporting member 155 having the cylindrical shape, the friction member 150 has a cylindrical shape. An outer diameter of the friction member 150 while the friction member 150 is assembled in the inner side of the supporting member 155 is greater than the inner diameter of the support portion 125 of the damper frame 120 and the inner diameter of the protrusion portion 143 of the screw gear 140. Therefore, a first end surface 151 of the friction member 150 in the first side of the axial direction may contact an end surface of the support portion 125 of the damper frame 120 in the second side, and a second end surface 152 of the friction member 150 in the second side of the axial direction may contact the protrusion portion 143 of the screw gear 140.

The supporting member 155 has the cylindrical shape, and protrusions 156 inwardly protruding from an inner circumferential surface are arranged at a center portion around an entirety of the perimeter in the axial direction. In an embodiment, the protrusion 156 may have a triangular cross-sectional shape, for example. An inner diameter of the supporting member 155 is set to allow the friction member 150 to contact an outer circumferential surface of the rod portion 111 of the rod 110. The inner diameter of the supporting member 155 is smaller than a value obtained by summing a diameter of the outer circumferential surface of the rod portion 111 and two times a thickness (a size in the radial direction) (t) of the friction member 150 (i.e., the inner diameter of the supporting member 155<the diameter of the outer circumferential surface of the rod portion 111+2t).

An axial-direction length of the supporting member 155 is less than an axial-direction length of the friction member 150. The supporting member 155 is disposed (e.g., mounted) around the friction member 150, such that, when viewing the supporting member 155 in a direction perpendicular to the axial direction, the first end surface 151 of the friction member 150 protrudes toward the first side from an end surface of the supporting member 155 in the first side, and the second end surface 152 of the friction member 150 protrudes toward the second side from an end surface of the supporting member 155 in the second side. An outer diameter of the supporting member 155 is less than the inner diameter of the first cylindrical-shape part 131 of the first accommodation part 121 of the damper frame 120. The supporting member 155 is provided between the support portion 125 and the screw gear 140 in the first accommodation part 121.

An inner diameter of the coil spring 159 is greater than an outer diameter of the supporting member 155, and an outer diameter of the coil spring 159 is less than the inner diameter of the first cylindrical-shape part 131 of the first accommodation part 121 of the damper frame 120. The coil spring 159 is provided at the outer side of the supporting member 155 in the first cylindrical-shape part 131 and the second cylindrical-shape part 132 of the first accommodation part 121 of the damper frame 120. An end of the coil spring 159 in the first side is supported by the end surface of the support portion 125 in the second side, and an end of the coil spring 159 in the second side is supported by an end surface of the protrusion portion 143 of the screw gear 140 in the first side. With respect to the support portion 125 of the damper frame 120 and the screw gear 140, the coil spring 159 provides an elasticity in a direction in which the support portion 125 of the damper frame 120 and the screw gear 140 are apart from each other. That is, the coil spring 159 elastically biases the damper frame 120 and the screw gear 140 to allow the spiral convex parts 142*a* and the spiral grooves 133*a* to engage with each other in the axial direction. In an embodiment, as described above, the coil spring 159 may be realized by a coil spring that surrounds the friction member 150 including an end supported by the screw gear 140 and an opposite end supported by the damper frame 120, for example.

The switching unit 160 may include the motor 161, the motor gear 170 (a transmission member) connected to a rotation axis 162 of the motor 161, the sensor 180 for detecting a rotation angle of the motor gear 170, and the control board 185 on which a driving circuit for driving the motor 161 is disposed (e.g., mounted).

In an embodiment, the motor 161 may be a stepping motor, for example. In an embodiment, the motor 161 may be fixed to an outer circumferential surface of the first accommodation part 121, e.g., an outer circumferential surface of at least one of the first cylindrical-shape part 131 or the second cylindrical-shape part 132, in the second accommodation part 122 of the damper frame 120, for example.

The motor gear 170 may include a shaft 171 having a cylindrical shape, the gear 172 disposed (e.g., mounted) at the shaft 171, and a plurality of protrusions 173 protruding from an outer circumferential surface of the shaft 171. A concave part 171*a* is defined at the shaft 171. The concave part 171*a* is concavely defined from an end surface of the shaft 171 in the first side. The rotation axis 162 of the motor 161 is inserted into the concave part 171*a*, such that the motor gear 170 and the rotation axis 162 of the motor 161 are connected with each other. By doing so, the motor gear 170 may rotate together with the rotation axis 162 of the motor 161. An end surface of the shaft 171 in the second side may be rotatably supported by the second accommodation part 122 of the damper frame 120, e.g., a through hole or a concave part defined in the second wall 122*b*.

The gear surface of the gear 172 is parallel to the axial direction. A part of a perimeter direction of the gear 172 passes through the communication hole 132*a* in the second cylindrical-shape part 132 of the damper frame 120 and engages with the gear of the gear portion 141 of the screw gear 140 in the first accommodation part 121. Accordingly, the motor gear 170 transmits a rotation driving force of the motor 161 to the screw gear 140. The axial-direction length of the gear 172 is less than the axial-direction length of the gear of the gear portion 141 of the screw gear 140, and is set to engage with the gear of the gear portion 141 even when the screw gear 140 is moved in the axial direction.

The plurality of protrusions 173 is provided at the shaft 171. In an embodiment, the plurality of protrusions 173 is arrayed at regular intervals in a perimeter direction of the shaft 171, for example. In an embodiment, eight protrusions 173 are provided at the shaft 171, for example. In an embodiment, each of the plurality of protrusions 173 may have a quadrangular shape, e.g., rectangular shape, for example. However, an array interval of the plurality of protrusions 173 may not be a regular interval.

The sensor 180 may be a transmissive optical sensor having a light-emitting portion 181 provided at the first side of the protrusions 173 of the motor gear 170, and a light-receiving portion 182 provided at the second side of the protrusions 173. The light-receiving portion 182 detects whether light emitted from the light-emitting portion 181 is blocked by the protrusions 173 of the motor gear 170, such that a rotation angle of the motor gear 170 may be detected. However, the disclosure is not limited thereto, and in another embodiment, the sensor 180 may have a structure in which the light-emitting portion 181 is provided at the second side of the protrusions 173 of the motor gear 170, and the light-receiving portion 182 is provided at the first side of the protrusions 173. The sensor 180 may be a reflective optical sensor other than the transmissive optical sensor.

The control board 185 is electrically connected to the control device 60 via the cord 186. The control board 185 outputs a detection value of the sensor 180 to the control device 60 via the cord 186. The control board 185 controls driving of the motor 40 by receiving a control signal from the control device 60 via the cord 186. The control board 185 may be supported by the second cover 124 of the damper frame 120. In an embodiment, the control board 185 may be connected to the second cover 124 by a fastening member such as a screw, a bolt, etc., for example.

With this structure, the switching unit 160 may switch, by rotating the screw gear 140, the damper 100 between a first state in which the friction member 150 and the damper frame 120 are movable together with respect to the rod 110 and a second state in which the friction member 150 and the rod 110 are movable together with respect to the damper frame 120.

Figure 4:
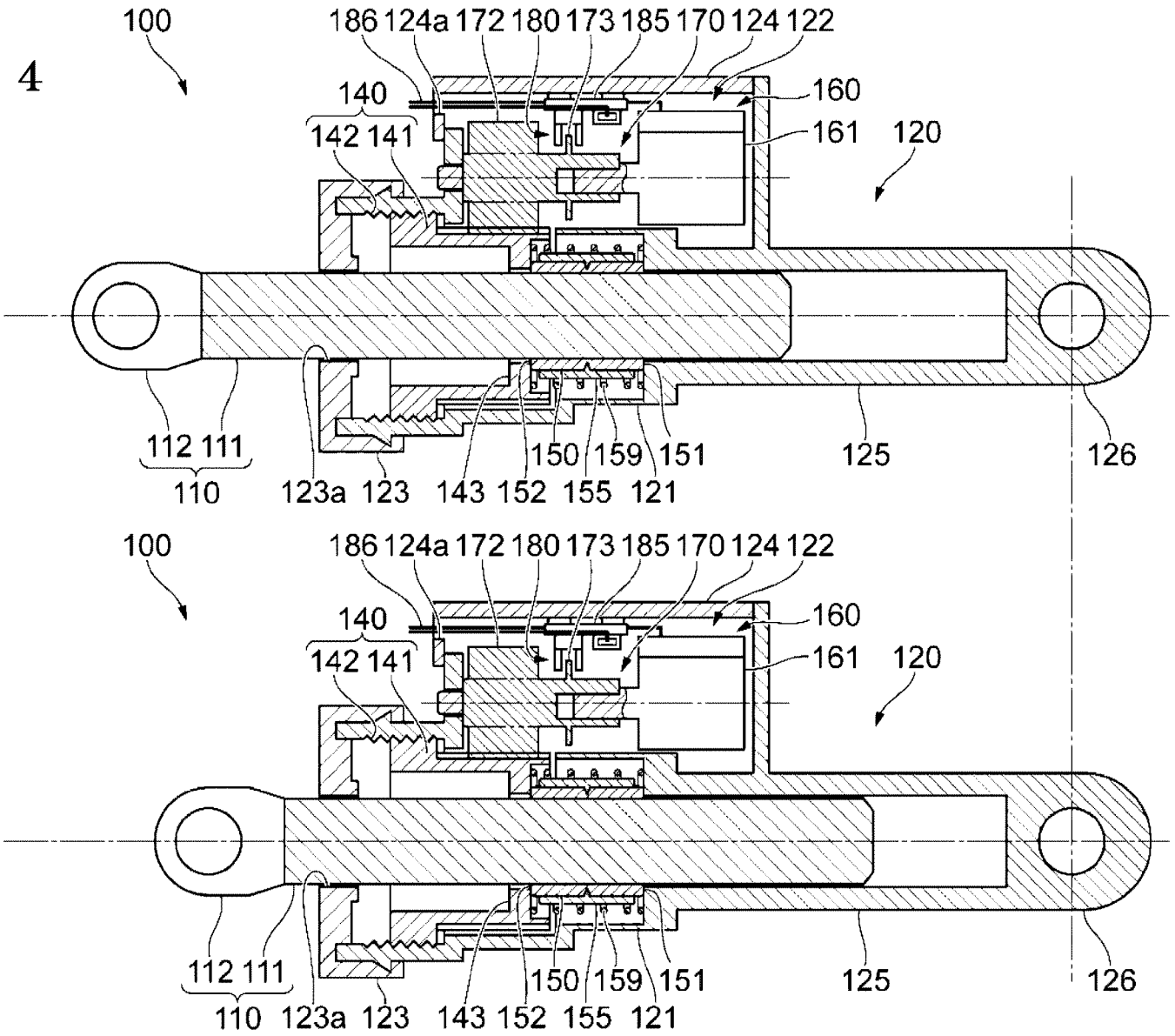
FIG. 4 illustrates an embodiment of extended/contracted forms of a damper in a first state, where (a) of FIG. 4 indicates a state in which the damper is extended, and (b) of FIG. 4 indicates a state in which the damper is contracted.
Figure 5:
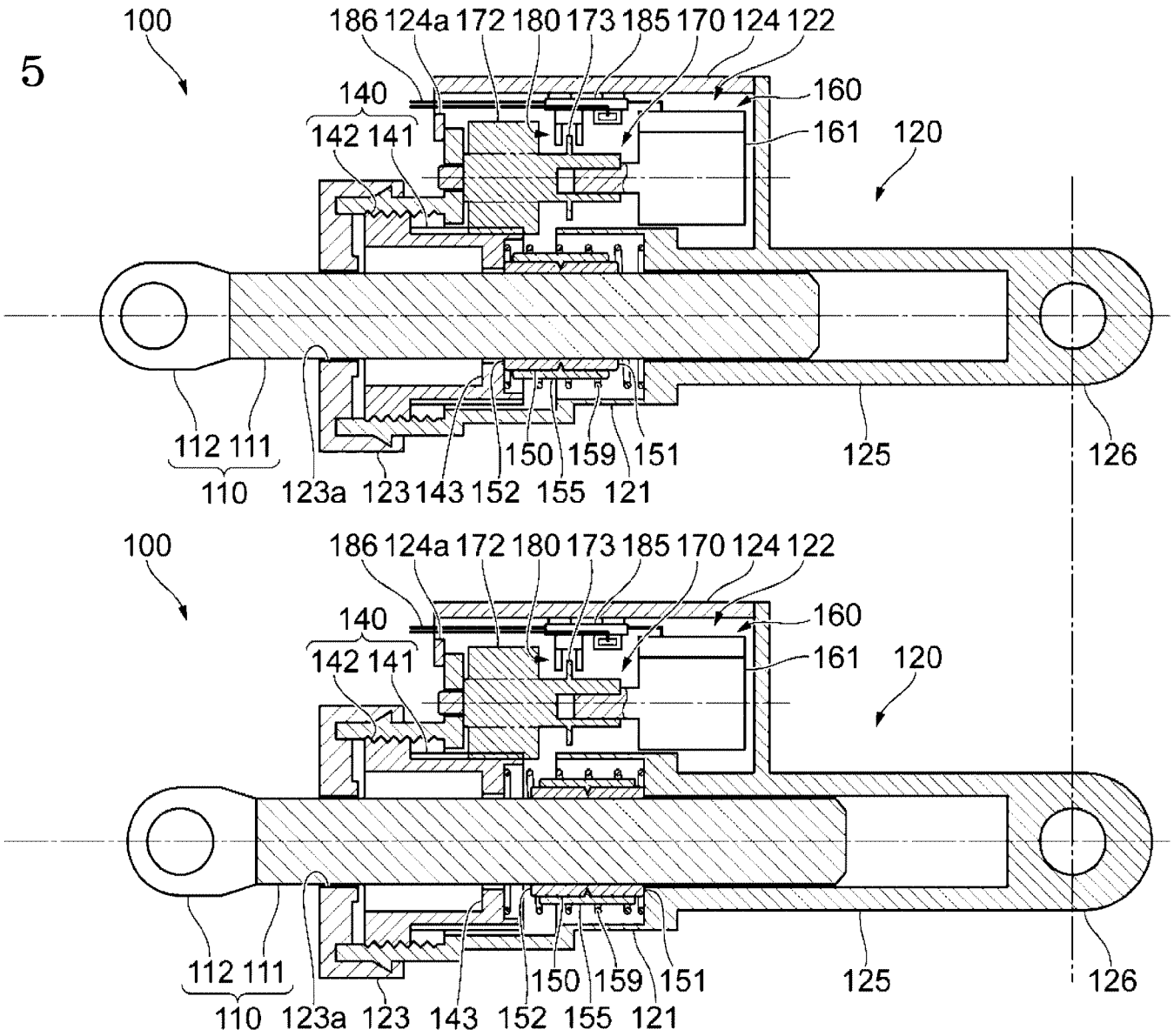
FIG. 5 illustrates an embodiment of extended/contracted forms of a damper in a second state, where (a) of FIG. 5 indicates a state in which the damper is extended, and (b) of FIG. 5 indicates a state in which the damper is contracted.

FIG. 4 illustrates an embodiment of extended/contracted forms of the damper 100 in the first state. (a) of FIG. 4 indicates a state in which the damper 100 is extended, and (b) of FIG. 4 indicates a state in which the damper 100 is contracted. FIG. 5 illustrates an embodiment of extended/contracted forms of the damper 100 in the second state. (a) of FIG. 5 indicates a state in which the damper 100 is extended, and (b) of FIG. 5 indicates a state in which the damper 100 is contracted.

Referring to FIG. 4, in the first state, the friction member 150 is interposed in the axial direction between the screw gear 140 and the damper frame 120, such that the friction member 150 and the damper frame 120 are moved as one body with respect to the rod 110. That is, as the first end surface 151 of the friction member 150 contacts the support portion 125 of the damper frame 120, and the second end surface 152 contacts the protrusion portion 143 of the screw gear 140, the friction member 150 cannot be moved with respect to the damper frame 120. Accordingly, when the tub 10 vibrates and thus the rod 110 and the damper frame 120 relatively move, the friction member 150 and the damper frame 120 are moved as one body with respect to the rod 110. As a result thereof, a damping force due to a friction force occurring between the friction member 150 and the rod 110 occurs.

In the second state, as illustrated in FIG. 5, a distance in the axial direction between the screw gear 140, in particular, the protrusion portion 143 of the screw gear 140, and the support portion 125 of the damper frame 120 becomes greater than the axial-direction length of the friction member 150. That is, the friction member 150 is movable in the axial direction between the screw gear 140 and the support portion 125 of the damper frame 120. Accordingly, when the tub 10 vibrates and thus the rod 110 and the damper frame 120 relatively move, the friction member 150 and the rod 110 are moved as one body with respect to the damper frame 120. As a relative movement does not occur between the friction member 150 and the rod 110, a friction force does not occur between the friction member 150 and the rod 110. As a result thereof, it is difficult that a damping force due to a friction force occurs.

Switching of the damper 100 from the first state to the second state or vice versa is implemented in a manner that the screw gear 140 is rotated by the motor 161 and thus is moved to the second side or the first side in the axial direction.

When the damper 100 is in the first state, and the rotation axis 162 of the motor 161 and the motor gear 170 are rotated in a first rotation direction by driving the motor 161, the screw gear 140 is rotated in a second rotation direction. The spiral convex parts 142*a* (refer to FIG. 2) of the screw gear 140 and the first accommodation part 121 (refer to FIG. 2), in other words, the spiral grooves 133*a* (refer to FIG. 2) of the third cylindrical-shape part 133 (refer to FIG. 2), engage with each other, and the first accommodation part 121 is not rotated, such that, when the screw gear 140 is rotated in the second rotation direction, the screw gear 140 is moved to the second side in the axial direction. By rotating the motor 161 by a predetermined rotation angle, the damper 100 may be switched from the first state to the second state.

When the damper 100 is in the second state and the motor 161 is driven to rotate the rotation axis 162 of the motor 161 and the motor gear 170 in the second rotation direction, the screw gear 140 is rotated in the first rotation direction. The spiral convex parts 142*a* of the screw gear 140 and the first accommodation part 121, in other words, the spiral grooves 133*a* of the third cylindrical-shape part 133, engage with each other, and the first accommodation part 121 is not rotated, such that, when the screw gear 140 is rotated in the first rotation direction, the screw gear 140 is moved to the first side in the axial direction. By rotating the motor 161 by a predetermined rotation angle, the damper 100 may be switched from the second state to the first state.

As described above, in the washing machine 1, the control device 60 controls the damper 100 to be in the first state until a rotation speed N of the drum 20 reaches a reference rotation speed Nt after a spin operation starts. The reference rotation speed Nt may be equal to or greater than the rotation speed N (e.g., 250 revolutions per minute (rpm)) of the drum 20 at which a resonance occurs in the washing machine 1. In an embodiment, the reference rotation speed Nt may be about 350 rpm, for example. When the damper 100 is in the first state, a damping force due to a friction force occurring between the friction member 150 and the rod 110 occurs at the damper 100, and thus, a vibration of the washing machine 1 becomes smaller than a vibration of a washing machine not having the damper 100. As the reference rotation speed Nt is equal to or greater than a resonance rotation speed of the drum 20, the vibration of the washing machine 1 may be reduced even at the resonance rotation speed of the drum 20.

When the rotation speed N of the drum 20 reaches the reference rotation speed Nt after a spin operation starts, the control device 60 switches the damper 100 from the first state to the second state. To this end, the control device 60 rotates the motor 161 by a predetermined rotation angle in the first rotation direction. When the damper 100 is in the second state, a friction force does not occur between the friction member 150 and the rod 110, such that it is difficult that a damping force due to the friction force occurs at the damper 100. In this case, when compared to a washing machine in which a damping force occurs even when the rotation speed N of the drum 20 is equal to or greater than the reference rotation speed Nt, in the washing machine 1 of the disclosure, it is difficult that a vibration of the drum 20 at the reference rotation speed Nt or more is transmitted to the housing 30. Accordingly, a vibration of the housing 30 in a case where the rotation speed N of the drum 20 is equal to or greater than the reference rotation speed Nt becomes smaller than that of a washing machine in which a damping force occurs even when the rotation speed N of the drum 20 is equal to or greater than the reference rotation speed Nt.

As described above, the damper 100 includes the damper frame 120 including one end (e.g., the second connection portion 126) supported by one member (a first member, e.g., the tub 10) of the tub 10 and the housing 30 which are two members that relatively move, and the rod 110 including one end (e.g., the first connection portion 112) supported by the other member (a second member, e.g., the housing 30). An opposite end (e.g., the rod portion 111) of the rod 110 is inserted into the damper frame 120, and is moved with respect to the damper frame 120 according to a movement of the first member with respect to the second member. The damper 100 includes the screw gear 140 (e.g., an embodiment of a rotation movement member) that is provided around the rod 110 in the damper frame 120, rotates in a direction perpendicular to the axial direction of the rod 110 with respect to the damper frame 120, and thus is movable in the axial direction with respect to the damper frame 120. The damper 100 includes the friction member 150 that is disposed between the support portion 125 (e.g., an embodiment of an insert portion) of the damper frame 120 which supports the rod 110 and the screw gear 140, contacts the outer circumferential surface of the rod 110 by being provided around the rod 110, and thus, applies a friction force with respect to the rod 110. The damper 100 includes the switching unit 160 (e.g., an embodiment of a switching means) that switches, by rotating the screw gear 140, the damper 100 between a first state in which the friction member 150 is movable together with the damper frame 120 with respect to the rod 110 and a second state in which the friction member 150 is movable together with the rod 110 with respect to the damper frame 120.

As described above, the damper 100 may be switched between the first state and the second state by rotating the screw gear 140, such that a structure of the damper 100 may be simplified, compared to a structure in which a member with a friction element is further arranged in the rod 110 or in the support portion 125 of the damper frame 120. Here, in the first state, the friction member 150 is interposed between the screw gear 140 and the damper frame 120, such that the friction member 150 and the damper frame 120 are moved as one body with respect to the rod 110, and in the second state, the friction member 150 and the rod 110 are moved as one body with respect to the damper frame 120. According to the structure above, a simple structure in which the damper 100 is switched between the first state and the second state by rotating the screw gear 140 may be implemented.

The damper frame 120 includes the first accommodation part 121 (e.g., an embodiment of an accommodation part) for accommodating the screw gear 140, and the first cover 123 (e.g., an embodiment of a cover) for covering an opening of the first accommodation part 121 and supporting a sliding operation of the rod 110. According to the structure above, the screw gear 140 may be securely and surely accommodated in the damper frame 120, such that it is possible to prevent the screw gear 140 from being damaged. Also, the rod 110 is slidably supported by the support portion 125 and the first cover 123 of the damper frame 120, and the screw gear 140 is arranged not to contact the rod 110. That is, the screw gear 140 exists independently from the rod 110 and is not affected by a force in the radial direction from the rod 110. Accordingly, the screw gear 140 may be smoothly rotated by engagement between the spiral convex parts 142*a* of the screw gear 140 and the spiral grooves 133*a* of the damper frame 120. That is, when the screw gear 140 is affected by the force in the radial direction from the rod 110, the screw gear 140 is not smoothly rotated due to an increased friction force of an engagement portion as the force in the radial direction is applied to the engagement portion of the spiral convex parts 142*a* of the screw gear 140 and the spiral grooves 133*a* of the damper frame 120. The screw gear 140 of the disclosure may be smoothly rotated as the screw gear 140 is not affected by the force in the radial direction from the rod 110. In other words, in order not to allow the force in the radial direction from the rod 110 to be applied to the screw gear 140, the rod 110 is slidably supported by the support portion 125 and the first cover 123 of the damper frame 120.

The spiral grooves 133*a* are defined in an inner circumferential surface of the damper frame 120, e.g., an inner circumferential surface of the first accommodation part 121, and the spiral convex parts 142*a* engaging with the spiral grooves 133*a* are defined in the outer circumferential surface of the screw gear 140. Accordingly, that the screw gear 140 may be moved in the axial direction by rotating the screw gear 140 in a direction perpendicular to the axial direction and thus the damper 100 is switched between the first state and the second state may be implemented via a simple structure. Also, the spiral grooves 133*a* and the spiral convex parts 142*a* defined around the rotation axis of the screw gear 140 engage with each other and thus a rotation driving force is converted into a movement in the axial direction of the screw gear 140, a deformation of the damper frame 120 may be suppressed, compared to a structure in which a force in the axial direction is applied to a part of a perimeter direction of the damper frame 120.

The damper 100 includes the coil spring 159 around the friction member 150, wherein one end of the coil spring 159 is supported by the screw gear 140, and an opposite end of the coil spring 159 is supported by the damper frame 120. In other words, the coil spring 159 is provided between the support portion 125 which supports the rod 110 in the damper frame 120 and the screw gear 140. Accordingly, the elasticity of the coil spring 159 is applied to the screw gear 140 in a direction of the second side, such that the screw gear 140 is elastically pushed to allow a second-side surface of the spiral convex parts 142*a* of the screw gear 140 contacts a first-side surface of the spiral grooves 133*a* of the damper frame 120. As a result thereof, even when a size of the spiral convex parts 142*a* of the screw gear 140 is less than a size of the spiral grooves 133*a* of the damper frame 120, when the tub 10 and the housing 30 relatively move, it is difficult that the spiral convex parts 142*a* of the screw gear 140 are moved relative to the spiral grooves 133*a* of the damper frame 120. Therefore, occurrence of noise due to an impact of the spiral convex parts 142*a* and the spiral grooves 133*a* may be suppressed. Also, in the second state in which the friction member 150 is movable together with the rod 110, even when the friction member 150 impacts the screw gear 140, the screw gear 140 has a structure with which movement with respect to the damper frame 120 is difficult, occurrence of noise due to an impact of the screw gear 140 and the damper frame 120 may be suppressed.

The switching unit 160 may include the motor 161, the motor gear 170 (e.g., an embodiment of a transmission member) including the gear 172 connected to the rotation axis 162 of the motor 161 so as to engage with the gear of the gear portion 141 formed in the outer circumferential surface of the screw gear 140 and transmitting a driving force of the motor 161 to the screw gear 140, and the sensor 180 for detecting a rotation angle of the motor gear 170. Accordingly, the control device 60 that controls an operation of the damper 100 is able to control driving of the motor 161, based on a detection value of the sensor 180. In an embodiment, it is possible that the screw gear 140 is surely moved by a predetermined distance to the second side by rotating the screw gear 140 by a predetermined rotation angle, when the damper 100 is switched from the first state to the second state, for example.

The motor gear 170 includes the plurality of protrusions 173 that outwardly protrude from the outer circumferential surface in the radial direction, and the sensor 180 is an optical sensor for detecting a rotation angle by detecting passing of the protrusions 173. Accordingly, it is possible to detect a rotation angle of the motor gear 170 with a relatively high reliability.

In the afore-described embodiment of the disclosure, the damper 100 is applied to the washing machine 1 and thus one end of the damper frame 120 supports a member of any one of the housing 30 or the tub 10 and one end of the rod 110 supports the other member of the housing 30 or the tub 10, but the disclosure is not limited thereto. The damper 100 may be arranged between any two members that move relative to each other. That is, it is possible that one end of the damper frame 120 supports any member (a first member) of the two members that move relative to each other, and one end of the rod 110 supports the other member (a second member) of the two members.

Figure 6:
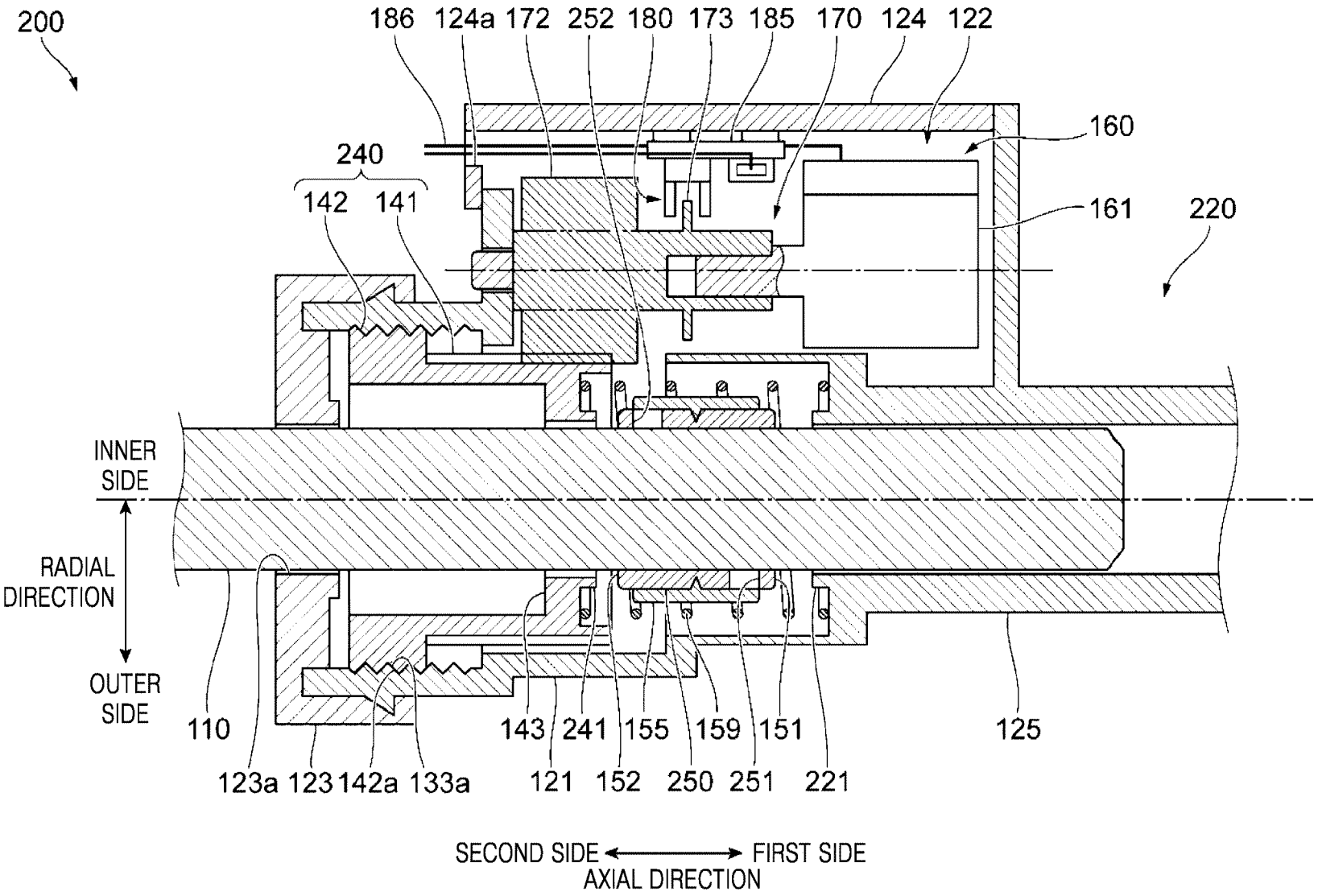
FIG. 6 illustrates a schematic configuration of an embodiment of a damper according to the disclosure.

FIG. 6 illustrates a schematic configuration of an embodiment of a damper 200 according to the disclosure. Referring to FIG. 2, compared to the damper 100, in the damper 200, a damper frame 220, a screw gear 240, and a friction member 250 which respectively correspond to the damper frame 120, the screw gear 140, and the friction member 150 are different. Hereinafter, a difference to the damper 100 described above will now be mainly described, and elements having the same functions as those of the damper 100 are given same reference numerals and descriptions thereof are not provided here.

Figure 7A:
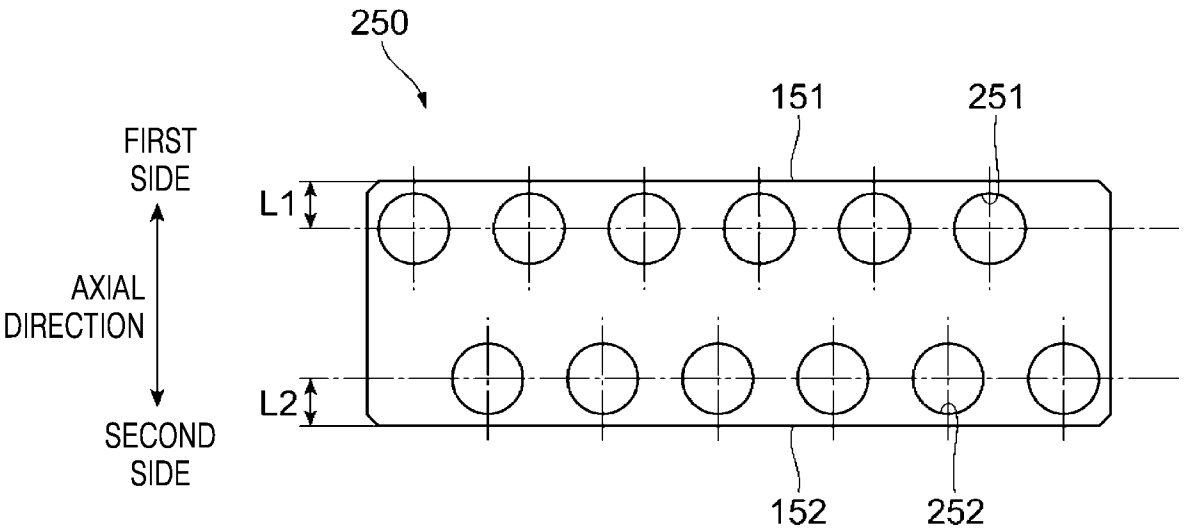
FIG. 7A is a plan view of an embodiment of a friction member, which illustrates the friction member before it is assembled in a supporting member.
Figure 7B:
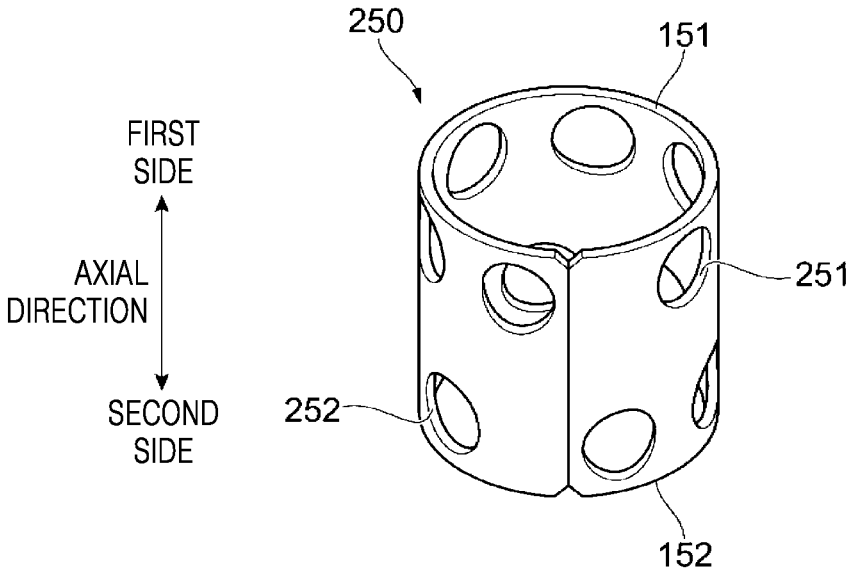
FIG. 7B is an exploded view of an embodiment of a friction member, which illustrates the friction member after it is assembled in a supporting member.

FIG. 7A is a plan view of an embodiment of the friction member 250, which illustrates the friction member 250 before it is assembled in the supporting member 155. FIG. 7B is an exploded view of an embodiment of the friction member 250, which illustrates the friction member 250 after it is assembled in the supporting member 155. Referring to FIGS. 7A and 7B, the friction member 250 in an embodiment of the disclosure is different from the friction member 150 in that through holes are defined in the friction member 250.

A first end surface 151 of the friction member 150 in the first side and a second end surface 152 of the friction member 150 in the second side are planes. In the friction member 250, a plurality of first through holes 251 (six holes in FIG. 7A) arrayed in a perimeter direction (a left and right direction in FIG. 7A) to the second side in the axial direction from the first end surface 151 and having a circular shape are defined. A center position of the plurality of first through holes 251 is apart from the first end surface 151 by a predetermined first distance L1. In the friction member 250, a plurality of second through holes 252 (six holes in FIG. 7A) arrayed in a perimeter direction (the left and right direction in FIG. 7A) to the first side in the axial direction from the second end surface 152 and having a circular shape are defined. A center position of the plurality of second through holes 252 is apart from the second end surface 152 by a predetermined second distance L2. In an embodiment, the first distance L1 and the second distance L2 may each be 4 mm, and a diameter of each of the first through hole 251 and the second through hole 252 may be 3 mm, for example. As such, the first distance L1 and the second distance L2, and the diameter of each of the first through hole 251 and the second through hole 252 are set such that the first end surface 151 and the second end surface 152 include planes and a concave part is not defined in the first end surface 151 and the second end surface 152. That is, each of the first distance L1 and the second distance L2 is greater than the diameter of each of the first through hole 251 and the second through hole 252.

The first through hole 251 and the second through hole 252 deviate from each other in a perimeter direction (the left and right direction in FIG. 7A). That is, as illustrated in FIG. 7A, a center position of the first through hole 251 deviates from a center position of the second through hole 252 in the perimeter direction. Accordingly, compared to a case where a center position of the first through hole 251 is equal to a center position of the second through hole 252 in the perimeter direction, durability of the friction member 250 may be improved. A material of the friction member 250 is not limited as long as the material has excellent wear resistance and is prone to elastic modification. In an embodiment, the material of the friction member 250 may include a urethane resin or a urethane rubber, for example. Also, the material of the friction member 250 may include nitrile butadiene rubber (NBR), hydrogenated nitrile butadiene rubber (H-NBR), ethylene-propylene diene monomer (EPDM) rubber, styrene butadiene rubber (SBR), and natural rubber (NR).

Compared to the damper frame 120, the damper frame 220 is different in that the damper frame 220 includes a first axial direction protrusion 221 protruding toward the second side in the axial direction from an end surface of the support portion 125 in the second side. In an embodiment, the first axial direction protrusion 221 may have a quadrangular shape, e.g., rectangular shape, for example. In an embodiment, the first axial direction protrusion 221 may be provided in a multiple number (e.g., eight protrusions) in a perimeter direction, for example.

Compared to the screw gear 140, the screw gear 240 is different in that the screw gear 240 includes a second axial direction protrusion 241 protruding toward the first side in the axial direction from an end surface of the protrusion portion 143 in the first side. In an embodiment, the second axial direction protrusion 241 may have a quadrangular shape, e.g., rectangular shape, for example. In an embodiment, the second axial direction protrusion 241 may be provided in a multiple number (e.g., eight protrusions) in a perimeter direction, for example.

Figure 8A:
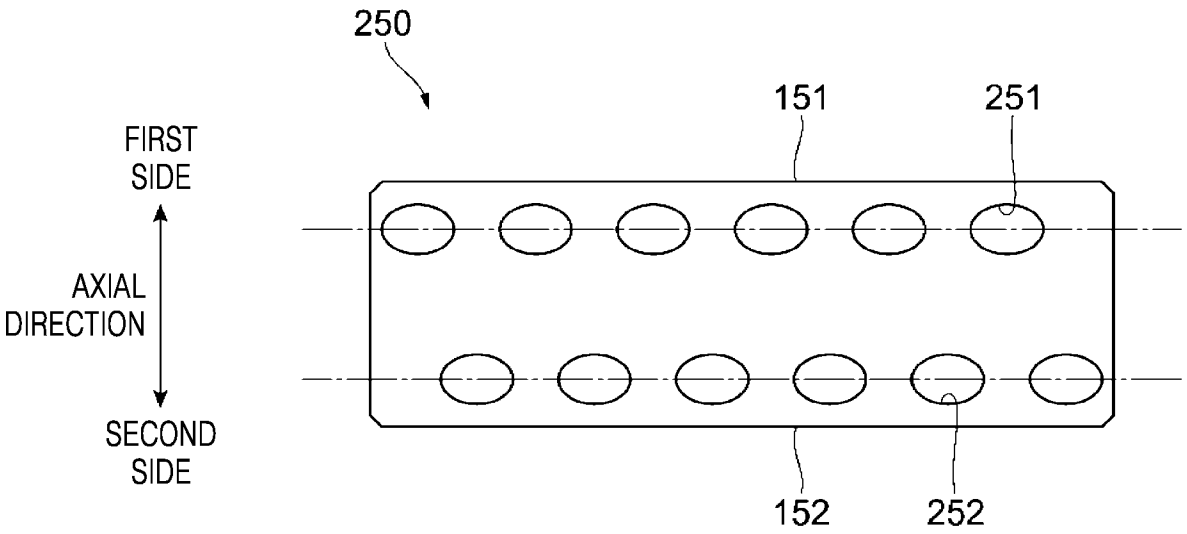
FIGS. 8A and 8B are plan views illustrating modifications of first through holes and second through holes of a friction member.
Figure 8B:
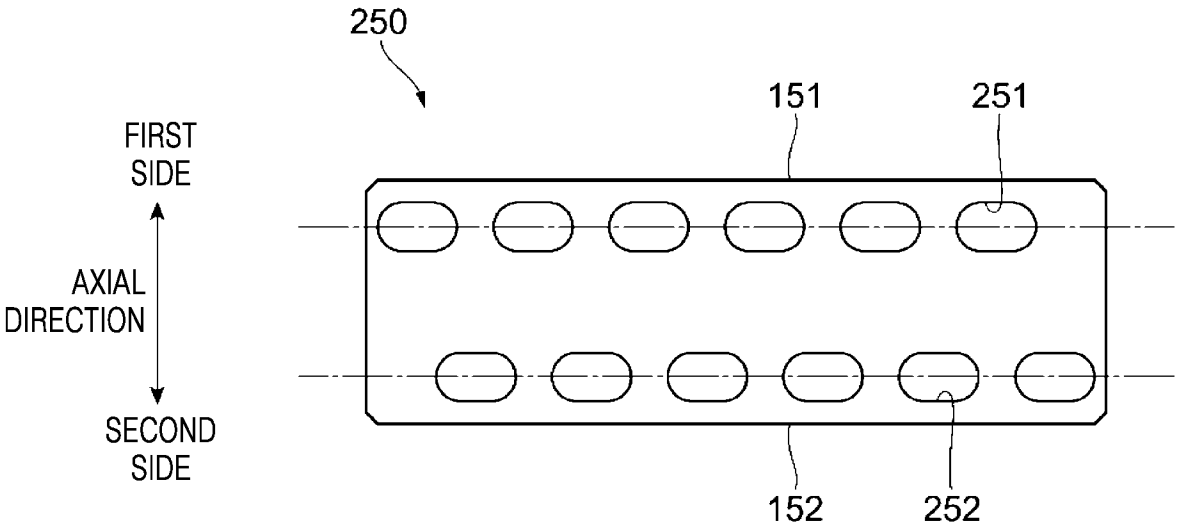

FIGS. 8A and 8B are plan views illustrating modifications of the first through holes 251 and the second through holes 252 of the friction member 250. A shape of the first through holes 251 and the second through holes 252 is not limited to a circular shape. In an embodiment, as illustrated in FIG. 8A, the first through hole 251 and the second through hole 252 may each have an oval shape in which a direction of a long axis is a perimeter direction (a left and right direction in FIG. 8A), for example. Although not illustrated, the first through hole 251 and the second through hole 252 may each have an oval shape in which a direction of a short axis is a perimeter direction, for example. Also, as illustrated in FIG. 8B, the first through hole 251 and the second through hole 252 may each have a shape in which two distant semicircles are connected by a pair of straight lines (hereinafter, the shape is also referred to as the "elongated circle"). In an embodiment, a length of the pair of straight lines may be equal to or different from a diameter of the semicircle. The first through hole 251 and the second through hole 252 may each have an elongated circle in which a direction of a long axis is a perimeter direction (a left and right direction in FIG. 8B), for example. Although not illustrated, the first through hole 251 and the second through hole 252 may each have an elongated circle in which a direction of a short axis is a perimeter direction.

Also, referring to FIG. 7A, the first distance L1 may be equal to or different from the second distance L2. Also, a shape of the first through hole 251 may be different from a shape of the second through hole 252. In an embodiment, one of the first through hole 251 and the second through hole 252 may have a circular shape and the other one may have an oval shape, for example.

As described above, in the damper 200 according to the disclosure, the friction member 250 has a cylindrical shape. The first end surface 151 and the second end surface 152 (e.g., an embodiment of an end surface) of the friction member 250 which respectively contact the screw gear 240 and the damper frame 220 are planes. In the friction member 250, the first through hole 251 and the second through hole 252 (e.g., an embodiment of a through hole) which pass through the friction member 250 in the radial direction are provided between the first end surface 151 and the second end surface 152 in a multiple number. Accordingly, even when the friction member 250 impacts the screw gear 240 or the damper frame 220, the friction member 250 is prone to be elastically deformed in the axial direction, such that the impact may be eased and occurrence of noise due to the impact may be suppressed.

A shape of the friction member 250 before being assembled between the damper frame 220 and the screw gear 240 is a quadrangular shape, e.g., rectangular shape. A shape of the first through hole 251 and the second through hole 252 before being assembled is one of a circle, an oval, and an elongated circle. Accordingly, it is possible that the friction member 250 has a shape prone to be elastically deformed while the first end surface 151 and the second end surface 152 maintain planes.

The damper frame 220 and the screw gear 240 each include the first axial direction protrusion 221 and the second axial direction protrusion 241 (e.g., an embodiment of a protrusion) which protrude in the axial direction around a contact with the friction member 250. Accordingly, a contact area between the damper frame 220 and the screw gear 240 and the first end surface 151 and the second end surface 152 may be decreased, and occurrence of noise due to an impact may be suppressed.

Furthermore, each of the first axial direction protrusion 221 and the second axial direction protrusion 241 may be provided in a multiple number (e.g., eight protrusions) while being apart from each other in a perimeter direction. Accordingly, compared to a case where the first axial direction protrusion 221 and the second axial direction protrusion 241 are formed over an entirety of the perimeter to have a cylindrical shape, a contact area between the first axial direction protrusion 221 and the second axial direction protrusion 241 and the first end surface 151 and the second end surface 152 may be further decreased, and occurrence of noise due to an impact may be further suppressed.

In the damper 200, the first axial direction protrusion 221 and the second axial direction protrusion 241 may not be formed on both the damper frame 220 and the screw gear 240. In an embodiment, the first axial direction protrusion 221 may be formed on the damper frame 220, and the second axial direction protrusion 241 may not be formed on the screw gear 240, for example. In an alternative embodiment, the second axial direction protrusion 241 may be formed on the screw gear 240, and the first axial direction protrusion 221 may not be formed on the damper frame 220.

The damper 200 includes the supporting member 155 that supports the friction member 250 and includes the cylindrical shape around the friction member 250, an outer diameter of each of the first axial direction protrusion 221 and the second axial direction protrusion 241 is less than an inner diameter of the supporting member 155, and an inner diameter of each of the first axial direction protrusion 221 and the second axial direction protrusion 241 is greater than an outer diameter of the rod 110. Accordingly, a contact between the first axial direction protrusion 221 and the second axial direction protrusion 241 and the supporting member 155 or the rod 110 may be suppressed.

Figure 9A:
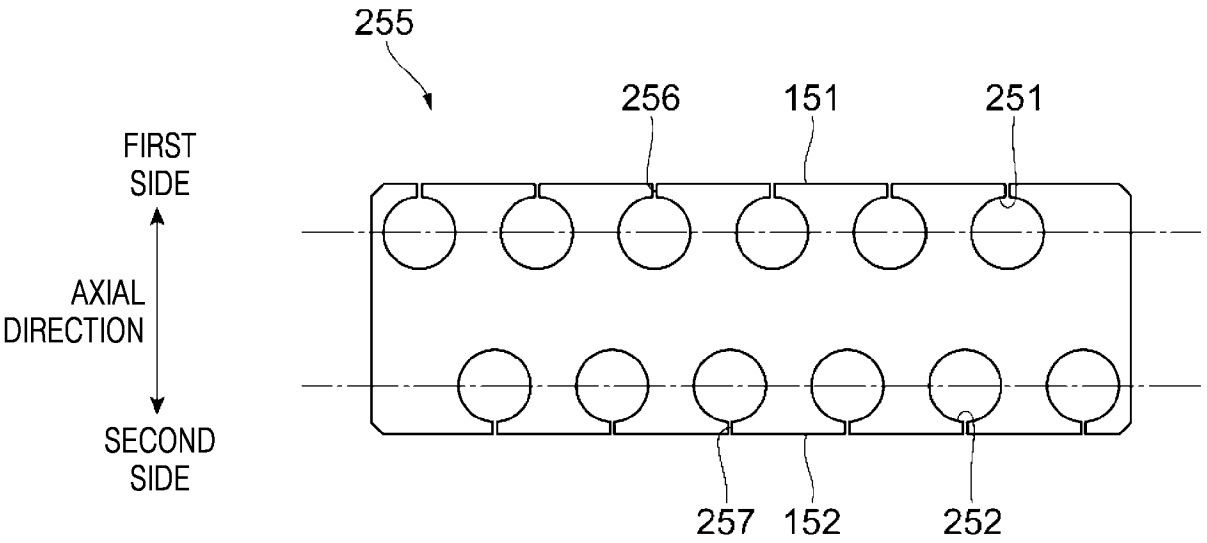
FIGS. 9A, 9B, and 9C illustrate modifications of a friction member.
Figure 9B:
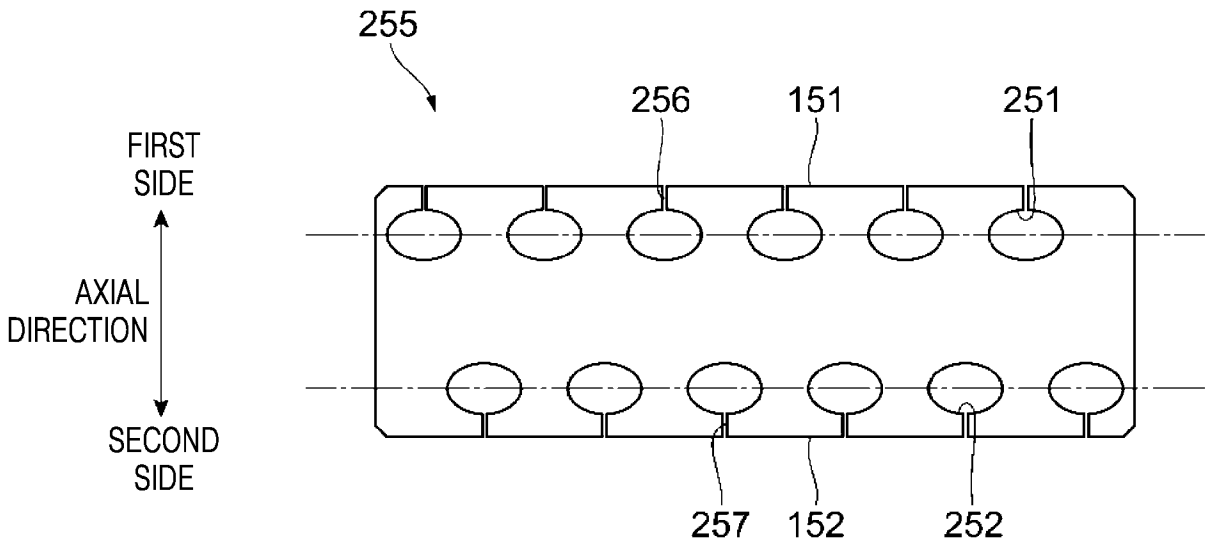
Figure 9C:
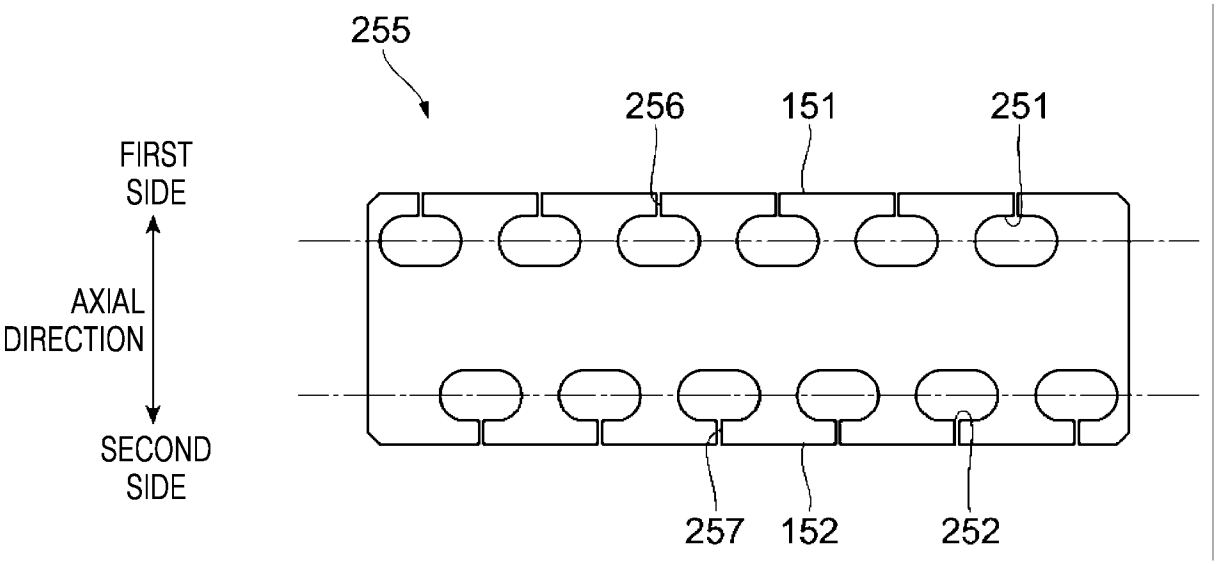

FIGS. 9A, 9B, and 9C illustrate modifications of a friction member 255. Referring to FIGS. 9A, 9B, and 9C, a first slit 256 defined between the first end surface 151 and the first through hole 251 may be defined in the friction member 255. Also, a second slit 257 defined between the second end surface 152 and the second through hole 252 may be further defined in the friction member 255. As the first slit 256 and the second slit 257 are defined, occurrence of noise due to an impact of the screw gear 240 and the damper frame 220 and the friction member 255 may be suppressed.

Figure 10:
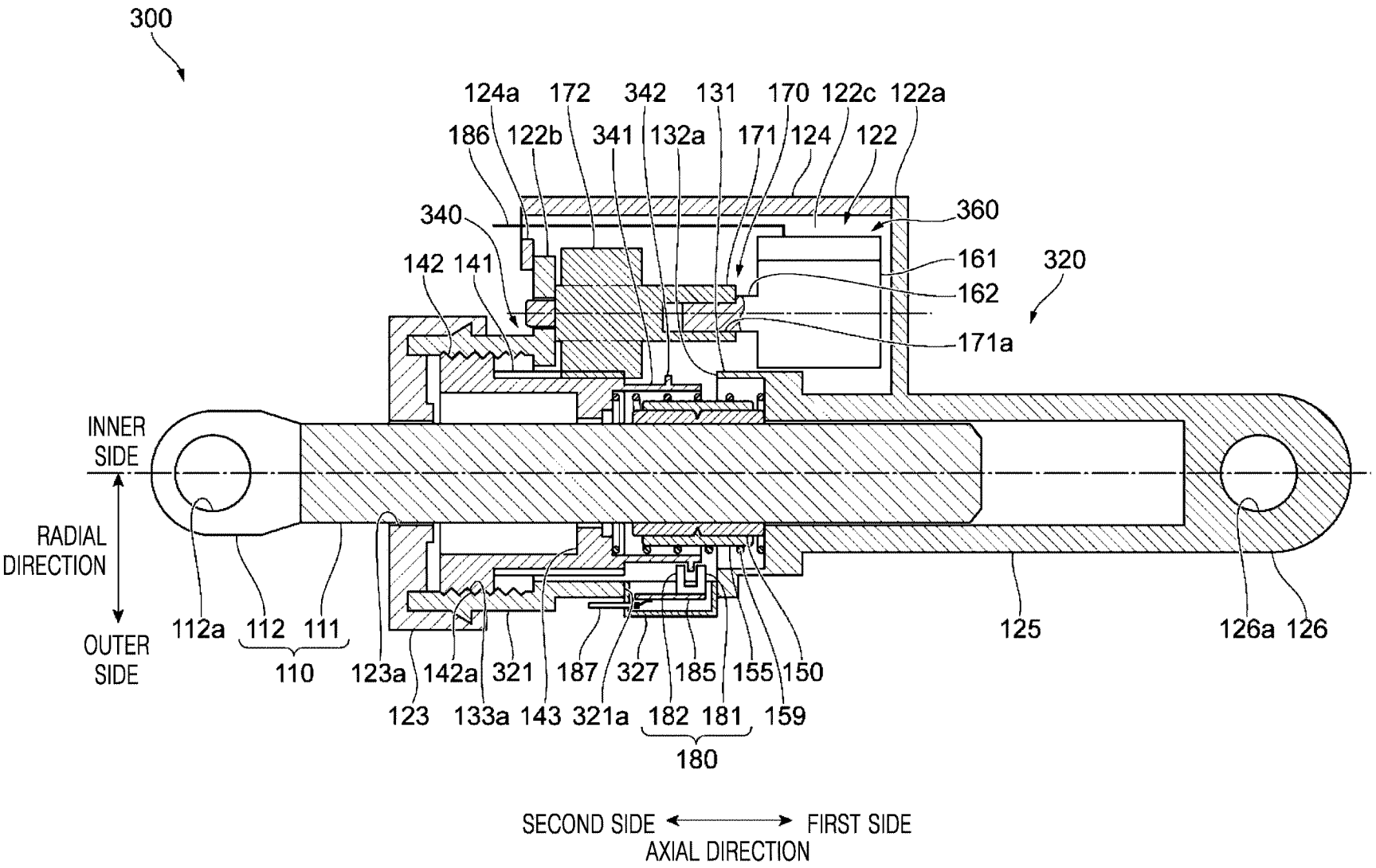
FIG. 10 illustrates a schematic configuration of an embodiment of a damper according to the disclosure.

FIG. 10 illustrates a schematic configuration of an embodiment of a damper 300 according to the disclosure. The damper 300 according to an illustrated embodiment of the disclosure is different from the damper 100 in that a damper frame 320 corresponding to the damper frame 120, a screw gear 340 corresponding to the screw gear 140, and a switching unit 360 corresponding to the switching unit 160 are different. Compared to the damper 100, the damper 300 in the illustrated embodiment of the disclosure is different in that the sensor 180 detects a rotation angle of the screw gear 340. Hereinafter, a difference to the damper 100 described above will now be mainly described, and elements having the same functions as those of the damper 100 are given same reference numerals and descriptions thereof are not provided here.

The damper frame 320 includes a first accommodation part 321 corresponding to the first accommodation part 121, the second accommodation part 122, the first cover 123, the second cover 124, the support portion 125, the second connection portion 126, and a third cover 327 covering an opening of the first accommodation part 321 in a perimeter direction. In the first accommodation part 321, an external communication hole 321*a* for communicating the inside with the outside is defined at a position that does not face the second accommodation part 122, i.e., a position where the communication hole 132*a* is not defined. The third cover 327 is disposed (e.g., mounted) at the first accommodation part 321 so as to cover the external communication hole 321*a* that is an opening in the first accommodation part 321. A form where the third cover 327 is disposed (e.g., mounted) at the first accommodation part 321 is not limited. The third cover 327 may be connected to the first accommodation part 321 by a fastening member such as a screw, a bolt, etc., or may be adhered to the first accommodation part 321.

The screw gear 340 includes a cylindrical-shape protrusion portion 341 as well as the gear portion 141, the screw portion 142, and the protrusion portion 143. The cylindrical-shape protrusion portion 341 protrudes in a cylindrical shape from an end surface of the gear portion 141 in the first side to the first side in the axial direction. An inner diameter of the cylindrical-shape protrusion portion 341 is greater than an outer diameter of the coil spring 159. An outer diameter of the cylindrical-shape protrusion portion 341 is less than that of the first cylindrical-shape part 131 of the first accommodation part 321 of the damper frame 320. A protrusion 342 is provided at an outer circumferential surface of the cylindrical-shape protrusion portion 341.

Figure 11A:
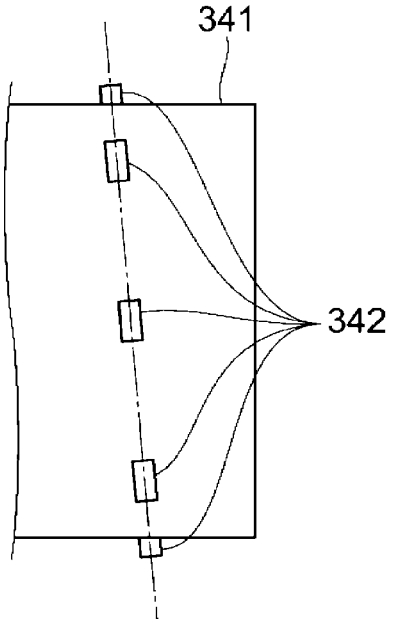
FIG. 11A illustrates a protrusion of FIG. 10, viewed in a direction perpendicular to an axial direction.
Figure 11B:
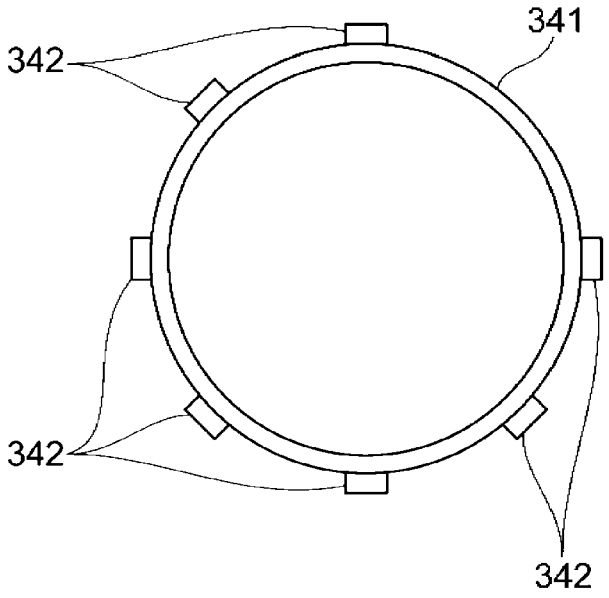
FIG. 11B illustrates the protrusion of FIG. 10, viewed in the axial direction.

FIG. 11A illustrates the protrusion 342 viewed in a direction perpendicular to the axial direction, and FIG. 11B illustrates the protrusion 342 viewed in the axial direction. Referring to FIGS. 10, 11A, and 11B, the screw gear 340 includes the protrusion 342 that outwardly protrudes from the outer circumferential surface of the cylindrical-shape protrusion portion 341 in the radial direction. In an embodiment, the protrusion 342 may have a quadrangular shape, e.g., rectangular shape, for example. In an embodiment, the protrusion 342 may be provided in a multiple number (seven protrusions in FIG. 11B) in a perimeter direction of the cylindrical-shape protrusion portion 341, for example. As illustrated in FIG. 11A, the plurality of protrusions 342 is formed along the same spiral as the spiral convex parts 142*a* of the screw portion 142. That is, a pitch and a slope of a virtual spiral formed by the plurality of protrusions 342 may be equal to a pitch and a slope of the spiral convex parts 142*a*. Also, the plurality of protrusions 342 may be arrayed at regular intervals in a perimeter direction.

As illustrated in FIG. 10, the switching unit 360 includes the motor 161, the motor gear 170, the sensor 180 for detecting a rotation angle of the screw gear 340, and the control board 185. The motor 161 and the motor gear 170 are installed in the second accommodation part 122, and the sensor 180 and the control board 185 are installed in the first accommodation part 321.

According to an illustrated embodiment of the disclosure, the sensor 180 includes the light-emitting portion 181 provided at the first side of the protrusions 342 of the screw gear 340, and the light-receiving portion 182 provided at the second side of the protrusions 342 and detects a rotation angle of the screw gear 340 by detecting, by the light-receiving portion 182, whether light emitted from the light-emitting portion 181 is blocked by the protrusions 342. The light-emitting portion 181 may be provided at the second side of the protrusions 342 of the screw gear 340, and the light-receiving portion 182 may be provided at the first side of the protrusions 342.

In the illustrated embodiment of the disclosure, the control board 185 is electrically connected to the control device 60 via a cord 187. The control board 185 outputs a detection value of the sensor 180 to the control device 60 via the cord 187. In the illustrated embodiment of the disclosure, the control board 185 is connected to the third cover 327 by a fastening member such as a screw, a bolt, etc., and thus, is supported by the third cover 327.

According to the structure, the switching unit 360 of the damper 300 in the illustrated embodiment of the disclosure includes the motor 161, the motor gear 170, and the sensor 180 for detecting a rotation angle of the screw gear 340 Accordingly, the control device 60 that controls an operation of the damper 300 is able to control driving of the motor 161, based on a detection value of the sensor 180, and thus it is possible that the screw gear 340 is surely moved by a predetermined distance to the second side by rotating the screw gear 340 by a predetermined rotation angle, when the damper 300 is switched from the first state to the second state, for example. Also, when the control device 60 switches the damper 300 from the second state to the first state, the control device 60 may surely moving the screw gear 340 by a predetermined distance to the first side by rotating the screw gear 340 by a predetermined rotation angle.

The screw gear 340 includes the plurality of protrusions 342, and the sensor 180 is an optical sensor for detecting a rotation angle by detecting passing of the protrusions 342. Accordingly, it is possible to detect a rotation angle of the screw gear 340 with a relatively high reliability. That is, even when the motor 161 or the motor gear 170 is out of order, a rotation angle of the screw gear 340 may be correctly detected. Also, as the screw gear 340 includes the protrusions 342, the motor gear 170 in the illustrated embodiment of the disclosure may not include the protrusions 173.

In the damper 300 in the illustrated embodiment of the disclosure, the second accommodation part 122 and the second cover 124 may be unitary. In an embodiment, the first wall 122*a*, the second wall 122*b*, and the third wall 122*c* are not provided at the outer side of the first accommodation part 321, and the second accommodation part 122 may be configured in a manner that walls corresponding to the first wall 122*a*, the second wall 122*b*, and the third wall 122*c* are arranged at a cover corresponding to the second cover 124.

The cylindrical-shape protrusion portion 341 may be a separate part from the gear portion 141, the screw portion 142, and the protrusion portion 143. In this case, the gear portion 141, the screw portion 142, and the protrusion portion 143 may be also referred to as rotation members, and the cylindrical-shape protrusion portion 341 is an embodiment of a member that rotates together with the rotation members, for example. In an embodiment, the cylindrical-shape protrusion portion 341, the gear portion 141, the screw portion 142, and the protrusion portion 143 may be unitary as one body by inserting the cylindrical-shape protrusion portion 341 into the protrusion portion 143. In this case, the switching unit 360 includes the motor 161, the motor gear 170, and the sensor 180 for detecting a rotation angle of the screw gear 340 by detecting passing of the protrusions 342 that protrude in the radial direction and are provided at the cylindrical-shape protrusion portion 341 rotating with the rotation members.

The damper frame 320, the screw gear 340, and the switching unit 360 of the damper 300 in the illustrated embodiment of the disclosure may be applied to the damper 200 described above.

Figure 12:
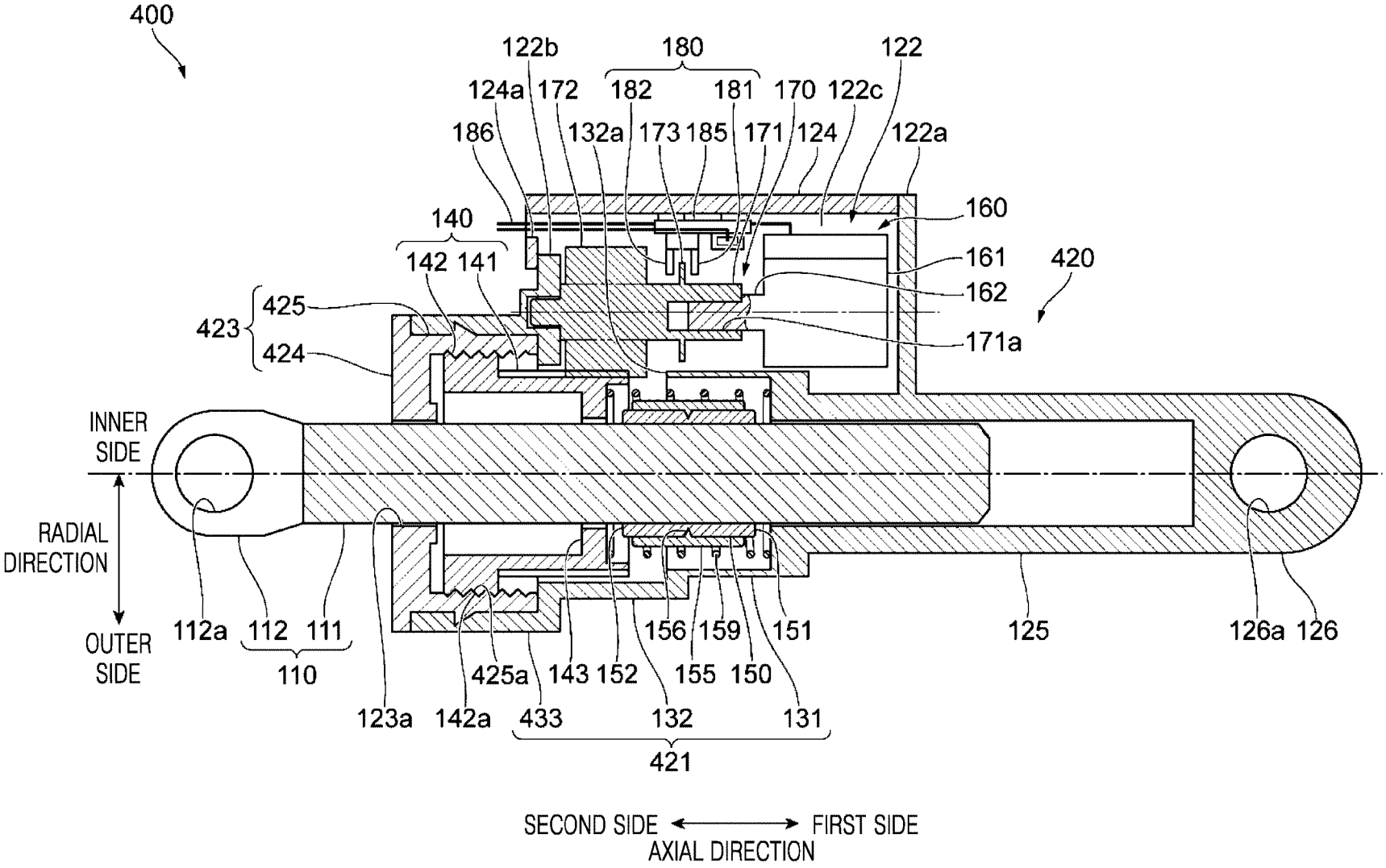
FIG. 12 illustrates a schematic configuration of an embodiment of a damper according to the disclosure.

FIG. 12 illustrates a schematic configuration of an embodiment of a damper 400 according to the disclosure. Compared to the damper 200 described above, the damper 400 according to the illustrated embodiment of the disclosure is different in a damper frame 420 corresponding to the damper frame 120. Referring to FIG. 12, the damper frame 420 includes a first accommodation part 421 corresponding to the first accommodation part 121, the second accommodation part 122, a first cover 423 corresponding to the first cover 123, the second cover 124, the support portion 125, and the second connection portion 126.

The first cover 423 includes a disc-shape portion 424 and a cylindrical-shape portion 425. The bearing 123*a* for supporting a sliding operation of the rod portion 111 of the rod 110 is disposed (e.g., mounted) at a center portion of the disc-shape portion 424. The cylindrical-shape portion 425 protrudes in a cylindrical shape from a surface of the disc-shape portion 424 in the first side to the first side. Spiral-shape grooves 425*a* to engage with the spiral convex parts 142*a* of the screw portion 142 are defined in an inner circumferential surface of the cylindrical-shape portion 425.

The first accommodation part 421 includes the first cylindrical-shape part 131, the second cylindrical-shape part 132, and a third cylindrical-shape part 433 corresponding to the third cylindrical-shape part 133 of the first accommodation part 121. An end of the third cylindrical-shape part 433 in the second side covers an external surface of the cylindrical-shape portion 425 of the first cover 423. A form where the first cover 423 is disposed (e.g., mounted) at the first accommodation part 421 is not limited. In an embodiment, as illustrated in FIG. 12, the cylindrical-shape portion 425 of the first cover 423 may be engaged with the end of the third cylindrical-shape part 433 of the first accommodation part 421 in the second side, for example. Furthermore, the first cover 423 may be connected to the first accommodation part 421 by a fastening member such as a screw, a bolt, etc., or may be adhered to the first accommodation part 421.

In the damper 400 in the illustrated embodiment of the disclosure, the damper frame 420 includes the first accommodation part 421 (e.g., an embodiment of an accommodation part) for accommodating the screw gear 140, and the first cover 423 (e.g., an embodiment of a cover) for covering an opening of the first accommodation part 421 and supporting a sliding operation of the rod 110. The spiral-shape grooves 425*a* are defined in an inner surface of the first cover 423, and the spiral convex parts 142*a* to engage with the spiral-shape grooves 425*a* are defined in an external surface of the screw gear 140. Accordingly, a structure in which the screw gear 140 may be moved in the axial direction by rotating the screw gear 140 in a direction perpendicular to the axial direction, and switching between a first state and a second state of the damper 400 is simple may be implemented. Also, as a rotation driving force is converted into a movement of the screw gear 140 in the axial direction by engaging the spiral-shape grooves 425*a* with the spiral convex parts 142*a* which are formed around a rotation axis that is a center of a rotation, deformation of the damper frame 420 may be suppressed, compared to a structure in which a force in the axial direction is applied to a part of a perimeter direction of the damper frame 420.

The damper frame 420 of the damper 400 in the illustrated embodiment of the disclosure may be applied to the damper 200 described above.

In the damper 400 in the illustrated embodiment of the disclosure, the third cylindrical-shape part 433 and the first cover 423 of the first accommodation part 421 may be applied instead of the third cylindrical-shape part 133 and the first cover 123 of the first accommodation part 321 of the damper 300 described above.

Figure 13:
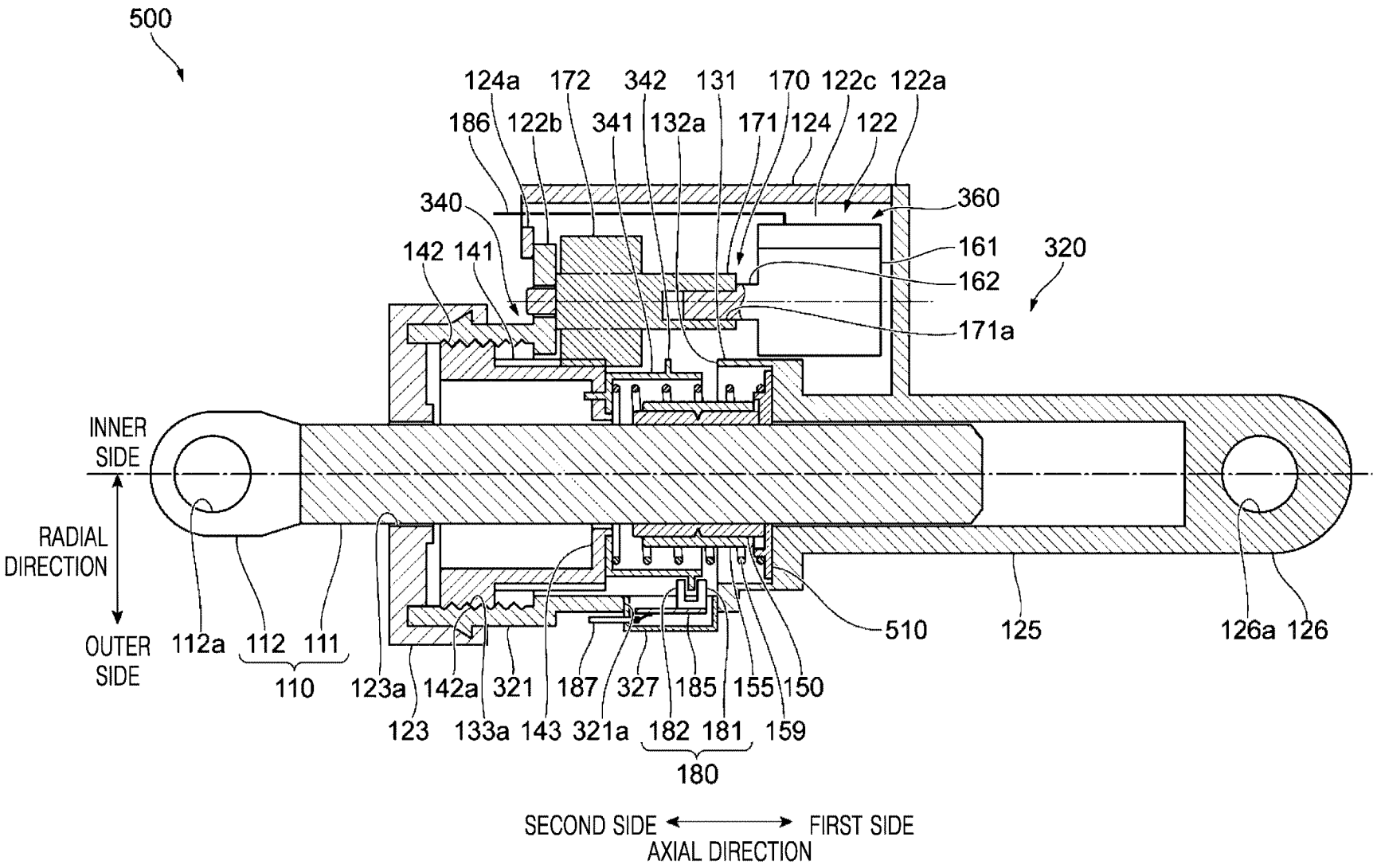
FIG. 13 illustrates a schematic configuration of an embodiment of a damper according to the disclosure.
Figure 14:
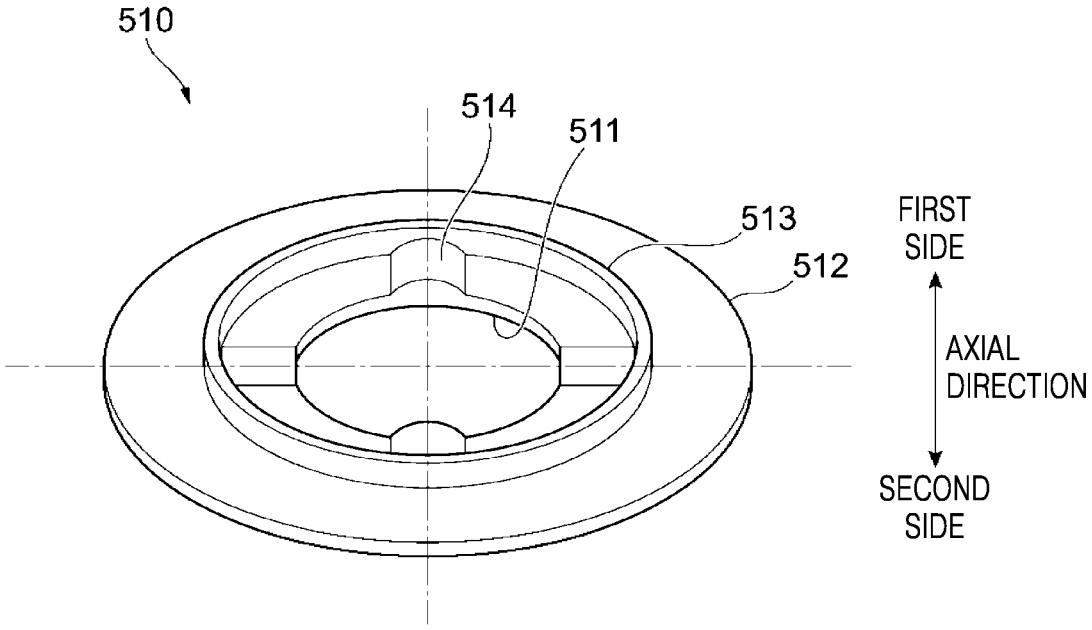
FIG. 14 illustrates a schematic configuration of an embodiment of an interposing member according to the disclosure.

FIG. 13 illustrates a schematic configuration of an embodiment of a damper 500 according to the disclosure. FIG. 14 illustrates a schematic configuration of an interposing member 510 according to the disclosure. Referring to FIG. 13, compared to the damper 300 of FIG. 10, the damper 500 is different in that the damper 500 includes the interposing member 510 interposed between an end of the coil spring 159 in the first side and the damper frame 320. Hereinafter, a difference to the damper 300 of FIG. 10 will now be mainly described, and elements having the same functions as those of the damper 300 of FIG. 10 are given same reference numerals and descriptions thereof are not provided here. Also, the screw gear 340 of FIG. 13 includes the gear portion 141, the screw portion 142, and the protrusion portion 143 which are formed as one body, and the cylindrical-shape protrusion portion 341 that is separately formed. The cylindrical-shape protrusion portion 341 is inserted into the protrusion portion 143.

Referring to FIG. 14, the interposing member 510 may be a circular-shape member in which a through hole 511 is defined at a center portion of the interposing member 510, and the rod portion 111 of the rod 110 passes through the through hole 511. In an embodiment, the interposing member 510 may include a circular-shape portion 512 with a relatively small thickness, a cylindrical-shape portion 513 protruding in a cylindrical shape from a surface of the circular-shape portion 512 in the second side to the second side, and a protrusion 514 protruding from the surface of the circular-shape portion 512 in the second side to the second side, for example. An outer diameter of the circular-shape portion 512 is less than an inner diameter of the first cylindrical-shape part 131 of the damper frame 320. Therefore, the circular-shape portion 512 is accommodated in the first cylindrical-shape part 131. An inner diameter of the cylindrical-shape portion 513 is greater than an outer diameter of the supporting member 155. An outer diameter of the cylindrical-shape portion 513 is equal to or less than an inner diameter of the coil spring 159. Therefore, the cylindrical-shape portion 513 is provided in the coil spring 159, thereby suppressing that the coil spring 159 deviates in the radial direction. The protrusion 514 is provided in an inner side of the cylindrical-shape portion 513 in the radial direction. In an embodiment, a plurality of the protrusions 514 may be arrayed at regular intervals in a perimeter direction, for example. In an embodiment, FIG. 14 illustrates four protrusions 514. The protrusion 514 may be formed in such a manner that a center portion in a perimeter direction protrudes most to the second side, for example. In an embodiment, a protrusion amount of the protrusion 514 to the second side may be gradually increased from an end portion to the center portion in the perimeter direction, for example. An end of one side of the friction member 150, e.g., an end in the first side may contact the protrusion 514.

As described above, the damper 500 according to an illustrated embodiment of the disclosure includes the coil spring 159 provided around the friction member 150. That is, the friction member 150 is provided in an inner side of the coil spring 159. One end (e.g., an end in the first side) of the coil spring 159 is supported by the screw gear 340, and an opposite end (e.g., an end in the second side) is supported by the interposing member 510. The interposing member 510 is interposed between the end of the coil spring 159 in the second side and the damper frame 320. According to the structure, even when the coil spring 159 is rotated as the screw gear 340 is rotated, the interposing member 510 supporting the end of the coil spring 159 in the second side is rotated with respect to the damper frame 320, such that the coil spring 159 may be smoothly rotated with respect to the damper frame 320. Also, the interposing member 510 may include the protrusion 514 at a contact with the friction member 150, the protrusion 514 protruding in the axial direction. Accordingly, a contact area between the interposing member 510 and the friction member 150 may be decreased, and occurrence of noise due to an impact of the interposing member 510 and the friction member 150 may be suppressed.

The interposing member 510 of the damper 500 in the illustrated embodiment of the disclosure may be applied to the damper 100 of FIG. 2, the damper 200 of FIG. 6, and the damper 400 of FIG. 12.

Figure 15A:
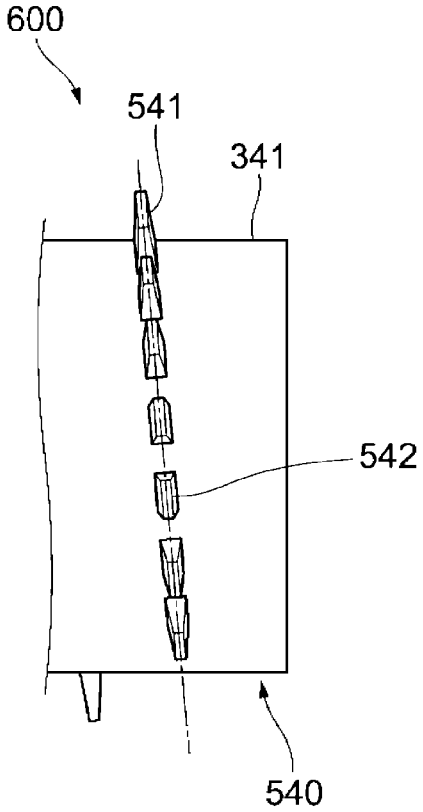
FIGS. 15A and 15B illustrate a schematic configuration of an embodiment of a protrusion group of a damper according to the disclosure.
Figure 15B:
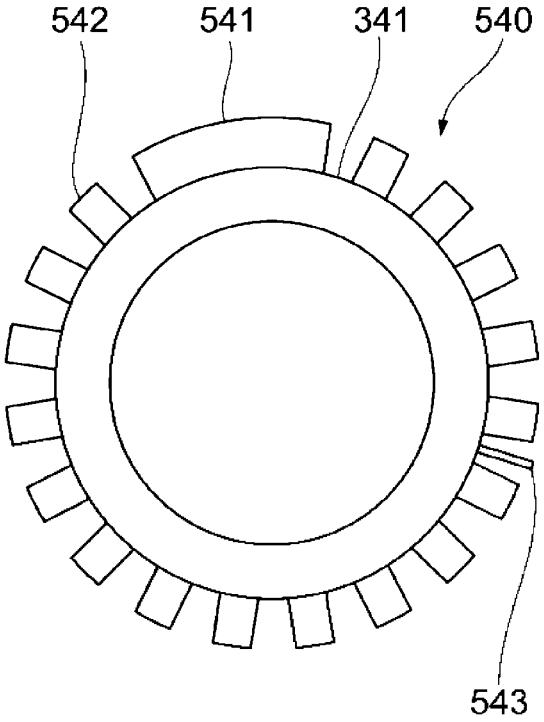

FIGS. 15A and 15B illustrate a schematic configuration of an embodiment of a protrusion group 540 of a damper 600 according to the disclosure. Compared to the damper 500 of FIG. 13, the damper 600 of FIGS. 15A and 15B is different in that the protrusion group 540 is employed, instead of the plurality of protrusions 342 provided at the cylindrical-shape protrusion portion 341 of the screw gear 340. Hereinafter, a difference to the damper 500 of FIG. 13 will now be described, and elements having the same functions as those of the damper 500 of FIG. 13 are given same reference numerals and descriptions thereof are not provided here.

Referring to FIGS. 15A and 15B, the protrusion group 540 may include a large-scale protrusion 541, a middle-scale protrusion 542, and a small-scale protrusion 543. The middle-scale protrusion 542 may be equal to the protrusion 342 shown in FIGS. 11A and 11B. A size of the large-scale protrusion 541 in a perimeter direction is greater than a size of the middle-scale protrusion 542 in the perimeter direction. A size of the small-scale protrusion 543 in the perimeter direction is less than the size of the middle-scale protrusion 542 in the perimeter direction. One large-scale protrusion 541 and one small-scale protrusion 543 are provided in a perimeter direction, and the middle-scale protrusion 542 is provided in a multiple number (seventeen protrusions in the embodiment of FIGS. 15A and 15B) in the perimeter direction. The protrusion group 540 is spirally provided in the perimeter direction. The protrusion group 540 is formed along the same spiral as the spiral convex parts 142*a* of the screw portion 142. That is, a pitch and a slope of a virtual spiral formed by the protrusion group 540 may be equal to a pitch and a slope of the spiral convex parts 142*a*. In an embodiment, a size of the large-scale protrusion 541 in the perimeter direction may be about 5 times a size of the middle-scale protrusion 542, for example. In the damper 600, the large-scale protrusion 541 is provided to be disposed between the light-emitting portion 181 and the light-receiving portion 182 of the sensor 180 in the second state.

When the sensor 180 detects that light emitted from the light-emitting portion 181 is blocked by anyone (e.g. the middle-scale protrusion 542) in the protrusion group 540, the sensor 180 outputs a signal (e.g., a relatively high signal) indicating a result of the detection. When the sensor 180 detects that light emitted from the light-emitting portion 181 is not blocked by a protrusion (e.g. the middle-scale protrusion 542), the sensor 180 outputs a signal (e.g., a relatively low signal) indicating a result of the detection. The control device 60 counts the number of first signals and the number of second signals received from the sensor 180, thereby controlling a movement of the screw gear 340 in the axial direction by recognizing how much the screw gear 340 has been rotated.

When switching from the first state to the second state, the control device 60 stops driving of the motor 161 when the control device 60 identifies that the screw gear 340 is moved to the second side in the axial direction and thus contacts the first cover 123. That is, as rotation of the screw gear 340 is stopped when the control device 60 identifies that the screw gear 340 is moved to the second side in the axial direction and thus contacts the first cover 123, an output from the sensor 180 received by the control device 60 is not changed from the first signal to the second signal or from the second signal to the first signal. After an output signal from the sensor 180 is not changed and then a predetermined period of time elapses, the control device 60 stops driving of the motor 161.

However, when the screw gear 340 is moved to the second side in the axial direction and thus contacts the first cover 123, and an end of a protrusion (e.g., the middle-scale protrusion 542) in the perimeter direction is disposed between the light-emitting portion 181 and the light-receiving portion 182, the output signal from the sensor 180 is not stable at one of the first signal or the second signal but is output while switching between the first signal and the second signal. As a result thereof, the output signal from the sensor 180 keeps changing even when the screw gear 340 contacts the first cover 123, and thus, the control device 60 may not stop driving of the motor 161 as the control device 60 cannot identify the contact between the screw gear 340 and the first cover 123

In the damper 600 shown FIGS. 15A and 15B, the large-scale protrusion 541 is set to be disposed between the light-emitting portion 181 and the light-receiving portion 182 of the sensor 180 when the screw gear 340 is in the second state in which the screw gear 340 contacts the first cover 123. Accordingly, compared to a case where the middle-scale protrusion 542 is set to be disposed between the light-emitting portion 181 and the light-receiving portion 182 of the sensor 180, it is difficult that an end of the large-scale protrusion 541 in the perimeter direction is disposed between the light-emitting portion 181 and the light-receiving portion 182. That is, as a size of the large-scale protrusion 541 in the perimeter direction is greater than a size of the middle-scale protrusion 542 in the perimeter direction, it is easy that the large-scale protrusion 541 is disposed between the light-emitting portion 181 and the light-receiving portion 182 of the sensor 180 in the second state in which the screw gear 340 contacts the first cover 123. As a result thereof, the control device 60 may surely stop driving of the motor 161 when the screw gear 340 contacts the first cover 123.

In an embodiment, a size of the small-scale protrusion 543 in the perimeter direction may be equal to or less than about half (½) the size of the middle-scale protrusion 542 in the perimeter direction, for example. Accordingly, a time interval between the first signal and the second signal which are output from the sensor 180 when the small-scale protrusion 543 passes a gap between the light-emitting portion 181 and the light-receiving portion 182 is smaller than a time interval between the first signal and the second signal which are output from the sensor 180 when the middle-scale protrusion 542 passes a gap between the light-emitting portion 181 and the light-receiving portion 182. By receiving, from the sensor 180, the first signal and the second signal when the small-scale protrusion 543 passes the gap between the light-emitting portion 181 and the light-receiving portion 182, the control device 60 may detect a rotation angle of the screw gear 340 with relatively high precision. Therefore, when switching from the second state to the first state, the control device 60 may stop the screw gear 340 at a desired position with relatively high precision, based on a detection value (a time interval between the first signal and the second signal) when the small-scale protrusion 543 passes a gap between the light-emitting portion 181 and the light-receiving portion 182. Also, when switching from the second state to the first state, the control device 60 may determine with relatively high precision that the screw gear 340 is moved to a predetermined position toward the first side in the axial direction, based on the first signal and the second signal when the small-scale protrusion 543 passes the gap between the light-emitting portion 181 and the light-receiving portion 182.

As described above, in the damper 600 shown in FIGS. 15A and 15B, the switching unit 160 includes the sensor 180 for detecting a rotation angle of the screw gear 340 by detecting passing of the protrusion group 540 protruding in the radial direction from an outer circumferential surface of the screw gear 340. The sensor 180 includes the light-emitting portion 181 and the light-receiving portion 182. The protrusion group 540 includes a first protrusion (e.g., the middle-scale protrusion 542), and a second protrusion (e.g., the large-scale protrusion 541) that has a size in the perimeter direction greater than a size of the middle-scale protrusion 542 in the perimeter direction and is disposed between the light-emitting portion 181 and the light-receiving portion 182 in the second state. In the damper 600 as described above, the control device 60 may surely stop driving of the motor 161 when the screw gear 340 contacts the first cover 123.

Also, the protrusion group 540 includes a third protrusion (e.g., the small-scale protrusion 543) having a size in the perimeter direction less than a size of the middle-scale protrusion 542 in the perimeter direction. Accordingly, the control device 60 may stop the screw gear 340 at a desired position with relatively high precision, based on a detection value (a time interval between the first signal and the second signal) when the small-scale protrusion 543 passes a gap between the light-emitting portion 181 and the light-receiving portion 182, and may determine with relatively high precision that the screw gear 340 is moved to a predetermined position toward the first side in the axial direction.

The protrusion group 540 of the damper 600 may be applied to the damper 100 of FIG. 2, the damper 200 of FIG. 6, the damper 300 of FIG. 10, and the damper 400 of FIG. 12.

The disclosure provides a damping device or a damper with a simple structure which suppresses a vibration of a tub of a washing machine. Applying of the damping device or the damper is not limited to the washing machine, and the damping device or the damper may be applied to suppress a vibration of at least one member from among two members moving relative to each other.

In an embodiment of the disclosure, a washing machine may include a housing, a tub supported to be relatively movable in the housing, a drum rotatably disposed (e.g., mounted) in the tub, and a damper disposed (e.g., mounted) between the housing and the tub. The damper may include a damper frame including one end supported by one of the housing and the tub, a rod including one end supported by the other one of the housing and the tub and an opposite end inserted into a support portion of the damper frame, such that the rod is movable with respect to the damper frame according to a relative movement between the housing and the tub, a rotation movement member provided around the rod in the damper frame and rotating with respect to the damper frame, such that the rotation movement member is movable with respect to the damper frame in an axial direction of the rod, a friction member which is disposed between the support portion of the damper frame and the rotation movement member in the axial direction and applies a friction force to the rod by contacting an outer circumferential surface of the rod, and a switching unit which switches, by rotating the rotation movement member, a state of the damper between a first state in which the friction member is movable together with the damper frame with respect to the rod and a second state in which the friction member is movable together with the rod with respect to the damper frame.

In an embodiment of the disclosure, the damper frame may include an accommodation part which accommodates the rotation movement member, and a cover covering an opening of the accommodation part in the axial direction and supporting a sliding operation of the one end of the rod.

In an embodiment of the disclosure, a spiral groove may be provided in the damper frame, and a spiral convex part may be provided at the rotation movement member so as to engage with the spiral groove.

In an embodiment of the disclosure, in the second state, a movement of the rod in the axial direction may be suppressed as the friction member contacts the rotation movement member or the damper frame.

In an embodiment of the disclosure, the friction member may have a cylindrical shape, and include an end surface which contacts the rotation movement member or the damper frame may be a plane.

In an embodiment of the disclosure, a plurality of through holes may be defined at inner portion of the friction member from both end surfaces of the friction member in the axial direction.

In an embodiment of the disclosure, a shape of the friction member before being assembled between the damper frame and the rotation movement member may be a quadrangular shape, e.g., rectangular shape, and a shape of each of the through holes before being assembled between the damper frame and the rotation movement member may be one of a circle, an oval, and an elongated circle.

In an embodiment of the disclosure, at least one of the damper frame or the rotation movement member may include a plurality of protrusions protruding in the axial direction around a contact with the friction member.

In an embodiment of the disclosure, the washing machine may further include a supporting member surrounding the friction member and supporting the friction member. An outer diameter of each of the protrusions may be less than an inner diameter of the supporting member. An inner diameter of each of the protrusions may be greater than an outer diameter of the rod. In an embodiment of the disclosure, the washing machine may further include a coil spring provided around the friction member, wherein one end of the coil spring is supported by the rotation movement member, and an opposite end of the coil spring is supported by the damper frame.

In an embodiment of the disclosure, the switching unit may include a motor, a transmission member having a gear to engage with a gear portion of the rotation movement member, and which transmits a driving force of the motor to the rotation movement member, and a sensor which detects a rotation angle of the rotation movement member.

In an embodiment of the disclosure, the transmission member may include a plurality of protrusions, and the sensor may include an optical sensor which detects the rotation angle by detecting the plurality of protrusions.

In an embodiment of the disclosure, the switching unit may include a sensor which detects a rotation angle of the rotation movement member by detecting a plurality of protrusions formed at the rotation movement member and protruding in the axial direction, and the plurality of protrusions may be spirally arrayed at regular intervals.

In an embodiment of the disclosure, a coil spring may be provided around the friction member. One end of the coil spring may be supported by the rotation movement member, and an interposing member may be interposed between an opposite end of the coil spring and the damper frame. The opposite end of the coil spring may be supported by the interposing member.

In an embodiment of the disclosure, the interposing member may include a protrusion at a contact with the friction member, the protrusion protruding in the axial direction.

In an embodiment of the disclosure, the switching unit may include a sensor which detects a rotation angle of the rotation movement member by detecting passing of a protrusion group spirally arrayed and protruding in a radial direction from an outer circumferential surface of one of the rotation movement member and a member rotating together with the rotation movement member.

In an embodiment of the disclosure, the sensor may include a light-emitting portion and a light-receiving portion. The protrusion group may include a first protrusion, and a second protrusion which has a size, in a perimeter direction, greater than a size of the first protrusion in the perimeter direction and which is disposed between the light-emitting portion and the light-receiving portion in the second state.

In an embodiment of the disclosure, the protrusion group may include a third protrusion which has a size, in the perimeter direction, less than the size of the first protrusion in the perimeter direction.

In an embodiment of the disclosure, the first protrusion may be provided in a multiple number at regular intervals in the perimeter direction.

In an embodiment of the disclosure, a damping device includes a damper frame and a rod. One end of the damper frame may be supported by one of two members that are movable relative to each other. One end of the rod may be supported by a remaining one of the two members. An opposite end of the rod may be inserted into a support portion of the damper frame. The rod may be movable with respect to the damper frame according to the relative movement of the two members. The damping device may include a rotation movement member, a friction member, and a switching unit. The rotation movement member may be provided around the rod in the damper frame. The rotation movement member may rotate with respect to a housing, thereby being movable with respect to the damper frame in an axial direction of the rod. The friction member may be disposed between the support portion of the damper frame and the rotation movement member in the axial direction. The friction member may apply a friction force to the rod by contacting an outer circumferential surface of the rod. The switching unit may switch, by rotating the rotation movement member, a state of the damping device between a first state and a second state. The first state may be a state in which the friction member is movable together with the damper frame with respect to the rod. The second state may be a state in which the friction member is movable together with the rod with respect to the damper frame.

While the washing machine and the damping device of the disclosure have been described with reference to the limited embodiments and drawings, various modifications and changes may be made from the descriptions by one of ordinary skill in the art.

The invention claimed is:

1. A washing machine comprising:

a housing;

a tub which is relatively movable in the housing;

a drum rotatably disposed in the tub; and a damper disposed between the housing and the tub, the damper comprising:

a damper frame including an end which is supported by one of the housing and the tub;

a rod including:

an end which is supported by a remaining one of the housing and the tub; and an opposite end which is inserted into a support portion of the damper frame, the rod being movable with respect to the damper frame according to a relative movement between the housing and the tub;

a rotation movement member provided around the rod in the damper frame and rotating with respect to the damper frame, the rotation movement member being movable with respect to the damper frame in an axial direction of the rod;

a friction member which is disposed between the support portion of the damper frame and the rotation movement member in the axial direction and applies a friction force to the rod by contacting an outer circumferential surface of the rod;

a supporting member surrounding the friction member and supporting the friction member;

a coil spring surrounding the supporting member; and a switching unit which switches, by rotating the rotation movement member, a state of the damper between a first state in which the friction member and the support member are movable together with the damper frame with respect to the rod and a second state in which the friction member and the support member are movable together with the rod with respect to the damper frame, wherein the damper frame includes a first cylindrical-shape part accommodating the friction member, the supporting member, and the coil spring, and an outer diameter of the supporting member is less than an inner diameter of the first cylindrical-shape part of the damper frame and an outer diameter of the coil spring is less than the inner diameter of the first cylindrical-shape part of the damper frame such that the coil spring is spaced apart from an inner surface of the first cylindrical-shape part of the damper frame.

2. The washing machine of claim 1, wherein the damper frame includes an accommodation part which accommodates the rotation movement member, and a cover covering an opening of the accommodation part in the axial direction and supporting a sliding operation of the end of the rod.

3. The washing machine of claim 1, wherein a spiral groove is provided in the damper frame, and a spiral convex part is provided at the rotation movement member and engages with the spiral groove.

4. The washing machine of claim 1, wherein a plurality of through holes is defined at an inner portion of the friction member from both end surfaces of the friction member in the axial direction.

5. The washing machine of claim 1, wherein at least one of the damper frame or the rotation movement member includes a plurality of protrusions protruding in the axial direction around a contact with the friction member.

6. The washing machine of claim 5, wherein an outer diameter of each of the protrusions is less than an inner diameter of the supporting member, and an inner diameter of each of the protrusions is greater than an outer diameter of the rod.

7. The washing machine of claim 1, wherein an end of the coil spring is supported by the rotation movement member, and an opposite end of the coil spring is supported by the damper frame.

8. The washing machine of claim 1, wherein an end of the coil spring is supported by the rotation movement member, an interposing member is interposed between an opposite end of the coil spring and the damper frame, and the opposite end of the coil spring is supported by the interposing member.

9. The washing machine of claim 1, wherein the switching unit comprises a sensor which detects a rotation angle of the rotation movement member by detecting passing of a protrusion group spirally arrayed and protruding in a radial direction from an outer circumferential surface of one of the rotation movement member and a member rotating together with the rotation movement member.

10. The washing machine of claim 9, wherein the sensor includes a light-emitting portion and a light-receiving portion, and the protrusion group includes a first protrusion, and a second protrusion having a size in a perimeter direction greater than a size of the first protrusion in the perimeter direction and which is disposed between the light-emitting portion and the light-receiving portion in the second state.

11. The washing machine of claim 10, wherein the protrusion group includes a third protrusion having a size in the perimeter direction less than the size of the first protrusion in the perimeter direction.

12. The washing machine of claim 10, wherein the first protrusion is provided in a multiple number at regular intervals in the perimeter direction.

13. A washing machine comprising:

a housing;

a tub which is relatively movable in the housing;

a drum rotatably disposed in the tub; and a damper disposed between the housing and the tub, the damper comprising:

a damper frame including an end which is supported by one of the housing and the tub;

a rod including:

an end which is supported by a remaining one of the housing and the tub; and an opposite end which is inserted into a support portion of the damper frame, the rod being movable with respect to the damper frame according to a relative movement between the housing and the tub;

a rotation movement member provided around the rod in the damper frame and rotating with respect to the damper frame, the rotation movement member being movable with respect to the damper frame in an axial direction of the rod;

a friction member which is disposed between the support portion of the damper frame and the rotation movement member in the axial direction and applies a friction force to the rod by contacting an outer circumferential surface of the rod; and a switching unit which switches, by rotating the rotation movement member, a state of the damper between a first state in which the friction member is movable together with the damper frame with respect to the rod and a second state in which the friction member is movable together with the rod with respect to the damper frame, wherein the switching unit comprises:

a motor;

a transmission member which includes a gear which engages with a gear portion of the rotation movement member, and transmits a driving force of the motor to the rotation movement member; and a sensor which detects a rotation angle of the rotation movement member.

14. The washing machine of claim 13, wherein the transmission member includes a plurality of protrusions, and the sensor comprises an optical sensor which detects the rotation angle by detecting the plurality of protrusions.

15. A washing machine comprising:

a housing;

a tub which is relatively movable in the housing;

a drum rotatably disposed in the tub; and a damper disposed between the housing and the tub, the damper comprising:

a damper frame including an end which is supported by one of the housing and the tub;

a rod including:

an end which is supported by a remaining one of the housing and the tub; and an opposite end which is inserted into a support portion of the damper frame, the rod being movable with respect to the damper frame according to a relative movement between the housing and the tub;

a rotation movement member provided around the rod in the damper frame and rotating with respect to the damper frame, the rotation movement member being movable with respect to the damper frame in an axial direction of the rod;

a friction member which is disposed between the support portion of the damper frame and the rotation movement member in the axial direction and applies a friction force to the rod by contacting an outer circumferential surface of the rod; and a switching unit which switches, by rotating the rotation movement member, a state of the damper between a first state in which the friction member is movable together with the damper frame with respect to the rod and a second state in which the friction member is movable together with the rod with respect to the damper frame, wherein the switching unit comprises a sensor which detects a rotation angle of the rotation movement member by detecting a plurality of protrusions disposed at the rotation movement member and protruding in the axial direction, and the plurality of protrusions is spirally arrayed at regular intervals.

* * * * *